US005340090A

United States Patent [19]

Orme et al.

[11] Patent Number: 5,340,090

[45] Date of Patent: Aug. 23, 1994

[54] METHOD AND APPARATUS FOR DROPLET STREAM MANUFACTURING

[75] Inventors: Melissa E. Orme, Los Angeles; Eric P. Muntz, Pasadena, both of Calif.

[73] Assignee: University of Southern California, Los Angeles, Calif.

[21] Appl. No.: 35,112

[22] Filed: Mar. 19, 1993

Related U.S. Application Data

[62] Division of Ser. No. 887,477, May 22, 1992, Pat. No. 5,226,948, and Ser. No. 575,271, Aug. 30, 1990, Pat. No. 5,171,360.

[51] Int. Cl.[5] ..... B22F 9/00

[52] U.S. Cl. ..... 266/202; 164/46

[58] Field of Search ..... 266/202, 236; 164/46; 75/338, 339, 331

[56] References Cited

U.S. PATENT DOCUMENTS

| | | | |
|---|---|---|---|
| 5,143,139 | 9/1992 | Leatham et al. | 75/338 |
| 5,176,874 | 1/1993 | Mourer et al. | 266/202 |
| 5,226,948 | 7/1993 | Orme et al. | 75/331 |

*Primary Examiner*—Scott Kastler

*Attorney, Agent, or Firm*—Harris, Wallen, MacDermott & Tinsley

[57] ABSTRACT

A method of manufacture of a net form product, including directing a stream of liquid from a nozzle onto a collector of the shape of the desired product, applying an amplitude and time dependent modulated disturbance to the stream to produce a droplet stream, and with the nozzle and collector in a chamber, controlling the chamber environment. An apparatus for manufacturing a net form product having a source of molten material under pressure, a support for positioning a product collector in a chamber with the collector defining a desired product, a droplet stream generator positioned within the chamber and including a nozzle, a conduit for conducting molten material from the material source to the generator nozzle, a mechanism, typically a modulator, for amplitude and time dependent modulation disturbance of the droplet stream, and a drive mechanism for relative movement of the nozzle and support.

21 Claims, 23 Drawing Sheets

METHOD AND APPARATUS FOR DROPLET STREAM MANUFACTURING

This application is a division of application Ser. No. 07/887,477 filed May 22, 1990 now U.S. Pat. No. 5,226,948, and a continuation-in-part of copending application Ser. No. 07/575,271, filed Aug. 30, 1990, now U.S. Pat. No. 5,5171,360 .

BACKGROUND OF THE INVENTION

The present invention relates to a new method and apparatus for constructing precision net form components as well as simpler forms with precisely controlled streams of material droplets in a background gas ranging from vacuum to above atmospheric pressures where the size, energy and rate of arrival of the droplets as well as the pressure and type of background gas can all be adjusted to optimize the construction and material properties of the component.

Conventional casting consists of pouring or injecting molten metal into a mold at a rate which is faster than the solidification rate. This well known procedure is suitable for the high volume production of small simple parts with reasonably uniform dimensions. However, several deficiencies in conventional casting has lead the metallurgy industry to research new techniques of materials processing. For example, in conventional casting segregation occurs in the production of most alloys. Also, it has been found that since the solidification time for casting is long, differences in the composition of the metallic part can occur.

Powder metallurgy (P/M) is a well established production process in which parts are made by compressing metal powders in a mold. Subsequent sintering (heating) is necessary to bond the particles to give the formed material strength and other desirable properties. The powder needs to be contained and formed by dies.

The advantage of powder metallurgy is that metals which are difficult to melt and to cast such as tungsten and tantalum can be economically fabricated by the P/M process. It can also be used to produce non-metallic parts. Generally speaking, P/M involves the steps of mixing, compacting and sintering. Further steps are often taken to improve the structural soundness of the P/M part such as infiltration and repressing. Strengths of the P/M process include the ability to fabricate complex shapes, the ability of precise material control or unusual material composition, and the ability of mass production. However, due to the nature of the P/M process, it is restricted to relatively small components. Further, the cost of the powder may limit the feasibility of P/M manufacturing to a narrow range of applications.

A new method of manufacturing called net form manufacturing is currently the topic of industrial as well as academic interest. Powder metallurgy is viewed by some researchers to be a type of near net form manufacturing even though additional manufacturing processes are required to assure structural strength after the part has been formed in the mold.

Net form manufacturing refers to that process where the final, or near final engineering part is made from the raw material in one integrated operation. Subsequent working is not required to enhance the structural qualities of the net formed part. For instance, in the developing technology of spray forming, a spray of molten metal is used as the manufacturing constituent to fabricate a part in its near net form. The spray is achieved by bombarding a stream of molten metal with an atomizing or nebulizing gas. Thus, the presence of the atomizing gas in the manufacturing environment is a required (though not necessarily desirable) feature of the currently developed technique of spray forming. The spray droplets travel in the gas environment and are deposited onto a collector. Either the collector or the spray may be moved so that the deposit is constructed in the desired shape. The molten metal droplets arriving at the solidifying surface remain where they are delivered, thus there is no need for a mold. The surface consists of a thin liquid film just a few microns thick. Once the droplets impinge on the surface they "splat", as if they had impinged on a solid surface. The splatting action causes the boundaries between the surface and the drop (splat) to disappear as the fluids mix. The splat solidifies almost immediately, thus prohibiting any significant lateral migration. It has been found that the material properties of the product depends on the splatting conditions. In spray forming, the near net formed part is processed further in order to achieve the characteristics of the final finished piece. Thus, spray manufacturing is termed here as near net manufacturing. Regardless of this detail, under careful conditions, the material structure of the final form will have a finer grain than those parts conventionally cast, and will be free of macroscopic segregation. Segregation, if any, will occur on the scale of a splat diameter. The combination of low segregation and fine grain size yields a product with enhanced mechanical properties. Moreover, since there are fewer manufacturing steps than in conventional processes, the production costs can be reduced.

See "The Osprey Preform Process," *Powder Metallurgy,* 1985, vol. 28, no. 1, pp. 13–20 for additional information on spray forming.

While it is clear that spray forming offers significant improvement over conventional processes in certain applications, there are several deficiencies present which may be overcome by using different methods. For example, the spray of molten metal droplets is for the most part uncontrolled. The droplets within the spray cone have a wide distribution of sizes and energies which can only be described statistically. This means that the smaller droplets may arrive at the surface presolidified, and there would be little cohesion between the particles in the deposit, resulting in an inhomogeneous material. Also, the dimensional fidelity of the net form part is limited by the lateral extent of the conical volume of particles. Smaller intricate parts cannot be made with this method without further work. And, due to the nature of the spray process, it is inevitable that overspray will occur, and that there will be high losses from scrap. The final deficiency noted is that the deposition environment is coupled with the atomizing technique, therefore making it impossible to fabricate materials in a vacuum environment, or an environment which is independent from the atomizing gas. It is submitted that use of controlled streams of droplets that are generated without the use of an atomizing or nebulizing gas, instead of droplet sprays, will lessen if not remove the above deficiencies associated with spray forming, as well as to preserve the benefits of low cost and added strength.

It would be advantageous to have droplets arriving at the thin liquid surface with uniform and controllable size and temperature. Also, in many circumstances the background gas in the spray chamber can be trapped in the solidifying material. Thus, decoupling the size and speed of the droplets from the background gas supply provides an opportunity to optimize the droplet deposition process in order to produce the highest quality materials. An ability to have a vacuum or reduced pressure gas as the background would be advantageous in removing the problem of trapped gases or gases in solution. Finally, in some circumstances, controlled amounts of reactive gases in the background may enhance the properties of the deposited materials.

As will be described in more detail below, net form manufacturing with liquid molten metal drops is found to alleviate many of the hindrances encountered in conventional manufacturing processes, as well as to increase the structural integrity of the part. It is an object of the present invention to provide a method and apparatus for such net form manufacturing.

Recent research has lead to the precise control of droplet stream generation. Precise control refers to the ability to generate a stream of droplets with speed differences as small as $1\times10^{-7}$ times the average droplet velocity, and angular deviations of the stream of typically a few times $1\times10^{-6}$ radians. Further, precise control refers to the ability to manipulate the configuration of the stream of droplets by adjusting an input disturbance to the droplet generator. It has been found that the fluid stream from which droplets are formed responds to the applied disturbance almost instantaneously (on the order of one disturbance wavelength). This means that a stream of droplets can be generated which are either very uniform ($1\times10^{-7}$ times the average droplet velocity), or have a predictable and highly controllable size and spacing distribution. It is another object of the present invention to provide a method and apparatus for use of these streams in production of net forms, a process sometimes referred to as precision droplet stream manufacturing, or PDSM.

The general phenomenon of capillary stream break-up in the break-up of a liquid jet should be considered. The controlled instability of a fluid stream is introduced by disturbing the stream, as by vibrating the stream with a sinusoidal, triangular or other periodic waveform. When a fluid stream is disturbed with a disturbance, the stream breaks into a series of droplets, preferably equally spaced droplets which are separated a distance corresponding to the wavelength of the disturbance. The resulting stream of droplets is separated a distance which corresponds to the wavelength of the disturbance.

A different break-up process occurs if the stream is perturbed with an amplitude modulated disturbance. FIGS. 1*a* and 1*b* are representations of the response of the stream when perturbed with an amplitude modulated disturbance based on the present understanding of the phenomenon. The stream condition at various times $t_1$ -$t_7$ of FIG. 1*a* is shown FIG. 1*b*. A disturbance is imposed on the stream and it grows until the stream begins to break. It continues to break until the situation illustrated as $t_5$ is reached. The droplets in this configuration are separated a distance corresponding to the wavelength of the fast or carrier frequency, and are thus termed "carrier" droplets. Unlike conventional droplets, i.e., droplets generated with a single frequency disturbance, the carrier droplets generated by the amplitude modulated disturbance have a predictable relative speed component. The carrier droplets with their corresponding relative speeds are illustrated in configuration $t_5$ in FIG. 1*b*. The predictable relative speed component should not be confused with the unpredictable speed fluctuations that are measured as speed dispersions. The relative speed components are a direct consequence of the amplitude modulated disturbance waveform. That is, since the radial amplitude of the stream at the forward and rearward extremes of the potential drop are not symmetric, the break times of the extremes will be different, resulting in a net impulse, or speed change on the drop. Thus, the value of relative speed component depends on the degree of modulation of the disturbance; a highly modulated disturbance will yield a higher value and vice versa. The nature of the component is that it forces the carrier drops to coalesce systematically into larger drops as illustrated by $t_7$ in FIG. 1*b*. The merging time, or the time represented by drops at $t_7$ is always much greater than the break time of the droplets represented by $t_5$, the time required to break into uniformly spaced carrier droplets. The merging time is predictable. The final drops are separated a distance commensurate with the wavelength of the slow or modulation frequency of the disturbance, and hence are called "modulation" drops. The modulation drops are much more uniform in spacing and have smaller speed dispersions than drops generated with a conventional single frequency disturbance. It should also be noted that the separation between droplets increases linearly with the frequency ratio N. A frequency ratio of 1 is defined here as a conventional single frequency disturbance. It has been found that as the frequency ratio increases, the velocity dispersion decreases approximately as 1/N.

See "New technique for producing highly uniform droplet streams over an extended range of disturbance wave numbers," *Review of Scientific Instruments* 58(2) February, 1987, pp. 279–284, and "Applications to Space Operations of Free-Flying Control Streams of Liquid,"AIAA85–1029 and the paper of the same title in *Journal of Spacecraft*, Vol 23, No. 4, July–August, 1986, pp. 411–419, for additional information on production of droplet streams with amplitude modulation.

Another and different break-up process occurs if the stream is perturbed with an amplitude and time dependent modulated disturbance. The time dependent modulation typically is frequency modulation or phase modulation.

SUMMARY OF THE INVENTION

A new method and apparatus have been conceived for the processing of materials in their net form. The process is characterized by the use of precisely controlled streams of liquid droplets, i.e., precision droplet stream manufacturing or PDSM. PDSM is related to the technology of spray manufacturing which is currently under development by others.

In spray manufacturing, the near net form product is achieved with the use of a spray of molten metal. The spray particles are deposited onto a collector and subsequently undergo rapid solidification. The reasons why this and other forms of net form manufacturing are beneficial are two-fold. First, because the route from the raw material to its final or near final shape is shortened, the manufacturing costs are reduced, and second, because of rapid solidification, the mechanical properties of the final net form are enhanced over those parts manufactured by conventional methods. In true net form manufacturing, the final part is achieved through one integrated procedure. The dimensional fidelity of the near net formed part is limited by the size of the spray cone. Other shortcomings of spray manufacturing include the uncontrollable nature of the sizes and speeds of the droplets within the spray which leads to a less homogeneous part, as the smaller droplets will cool faster and may pre-solidify before deposition. Overspray and losses due to scrap are further weaknesses of spray forming.

In contrast, the deposition process of the present invention is achieved with precisely controlled streams of liquid droplets, where the speeds and sizes of the droplets are predetermined and easily varied. Due to this character of the invention, the resolution of the net formed parts is limited only by the droplet size, and can be as low as about two times the diameter of the liquid stream from which the droplets are formed. Along with increased resolution, the net formed part is more homogeneous since each drop is the same size, and thus there is no distribution in cooling rates. Losses from overspray are reduced due to excellent directional control of the stream of droplets. Thus, the newly conceived technique of the invention is expected to overcome the shortcomings associated with spray forming as well as maintain, if not enhance, the benefits associated with net form manufacturing.

The technique of generating streams of drops in a vacuum environment which are more uniform and more controllable than those generated with spray methods is used in the present invention. Droplet speed variations as small as $1\times10^{-7}$ times the average droplet speed can be easily achieved when using this technique. Other droplet stream configurations, where the spacing and the size of each droplet in the stream can be varied in a predictable and controllable manner can be achieved by a combination of amplitude and time dependent modulation.

In precision droplet stream manufacturing droplet generation and subsequent propagation can take place either in a vacuum environment in order to fabricate a net form free of embedded gases, or in a regulated inert atmosphere for controlling the properties of the solidified material. Specific examples of PDSM are illustrated in FIGS. 2, 3, 4 and 5. In each case, the genesis of the droplets is due to capillary stream break-up. Stagnation pressure is applied to the liquid material and drives the fluid flow through the nozzles of the droplet generator. A fluctuating pressure component in the form of an amplitude and time dependent modulation, applied near the nozzle with a piezoelectric crystal or other actuator such as an electromagnetic vibrator, initiates a disturbance on the fluid column. The resulting droplet stream essentially "mimics" the form of the applied disturbance, with a response time of the order of one wavelength of the disturbance waveform. The droplets are deposited onto a collector before they solidify. Subsequent rapid solidification causes the deposit to have a uniform structure which is virtually free of segregation. Alloys also may be produced with the method and apparatus of the invention.

The invention also comprises novel details of construction and method steps, and novel combinations and arrangements of parts and steps, together with other objects, advantages, features and results which will more fully appear in the course of the following description.

DESCRIPTION OF THE PREFERRED EMBODIMENTS

Figure 2:
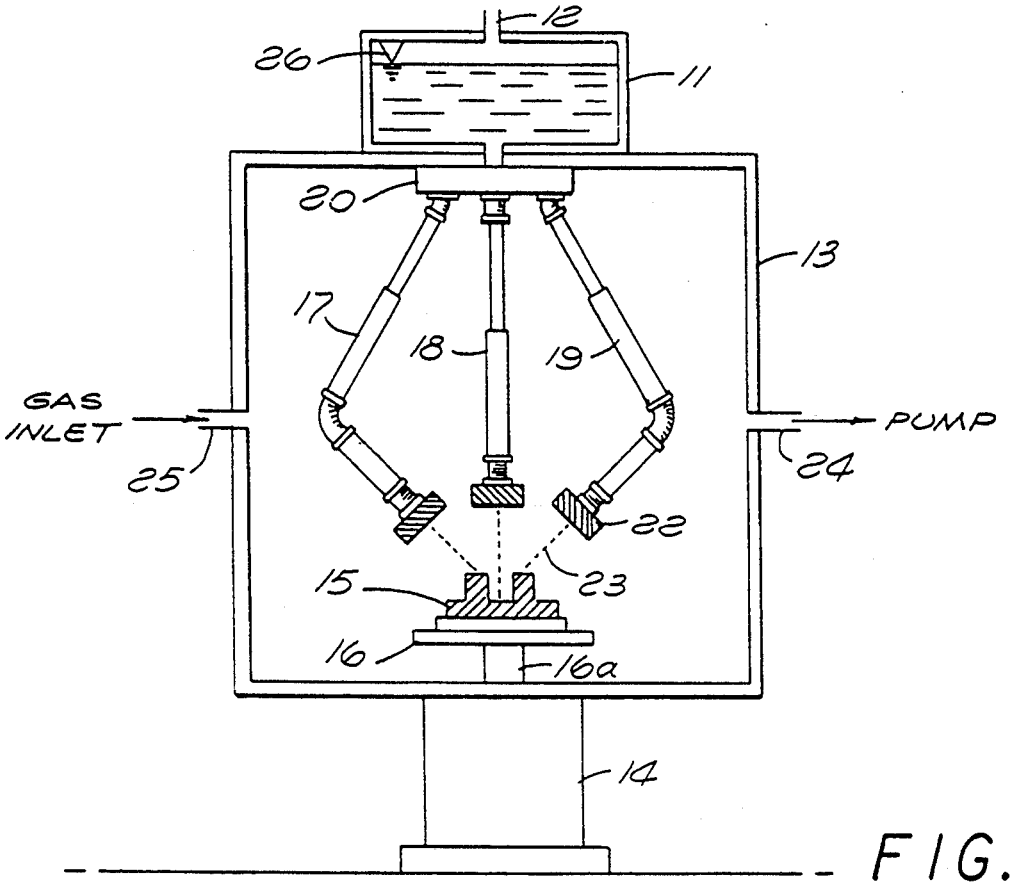
FIG. 2 illustrates an apparatus utilizing a plurality of single stream generators in production of a multiple faceted shaped part and incorporating an embodiment of the invention.

The apparatus of FIG. 2 uses a plurality of single droplet stream generators for the manufacture of a net form product on a collector, and is especially suited for producing a multiple faceted part. The collector may define a desired shape, such as that shown in FIG. 2, or may be a flat plate or the like on which the product is built up by stream control.

The source for the streams is a tank 11 of material in liquid form. A pressure source is connected at the tank at inlet 12 to provide for flow of the material from the tank 11 into a manifold 20 and then into one or more robotic arms 17, 18, 19. The liquid material desirably has a viscosity less than about 200 centipoise. Typical materials include molten metals such as aluminum, iron and alloys, and various epoxys.

The arms 17, 18, 19 are positioned within a chamber 13 which may be supported on a stand 14, with a collector 15 carried on a base 16 within the chamber. The collector may be used to define the shape of the net form product to be produced. Each of the robotic arms includes a droplet stream generator 22 with a nozzle which produces a single stream 23 of droplets. The environment within the chamber 13 may be controlled by a vacuum pump connected at an outlet 24 and a gas source connected at an inlet of 25. A sensor 26 for a liquid level controller may be mounted in the tank 11 if desired. Each generator includes means for producing a disturbance in the stream, preferably a modulator, such as that described in the aforementioned paper in *Review of Scientific Instruments*, or in the article by Orme and Muntz in *Physics of Fluids A*, vol. 2, no. 7, July 1990, pages 1124–1140.

Conventional means for driving the base 16 along x, y and z axes may be included in or adjacent the base-to-chamber support **16*a*, as desired. Conventional means for driving each of the robotic arms along x, y and z axes may be mounted in the chamber at or adjacent the tank 11**, as desired.

In operation, the liquid material is forced from the tank 11 to the manifold 20 and the arms 17 , 18 , 19 to the generator nozzles 22. The arms may be moved to direct the droplet streams over the surfaces of the collector. Also, the collector support base 16 may be moved to vary the aiming points of the streams 23 .

The droplet streams are generated by a disturbance, preferably periodic and amplitude modulated, and may be constructed and operated in the manner disclosed in the aforementioned publications. The embodiment of FIG. 2 is especially suited for making smaller detailed parts . The single streams of liquid droplets are directed by the robotic arms onto the deposit on the collector. Rapid and incremental solidification occurs as each droplet arrives at the deposit. Successive droplet depositions build the near or final form. Since the angular spread of a single stream of liquid droplets is of the order of $1\times10^{14\ 6}$ radians, the resolution of the detailed part is limited by the size of the droplet deformation upon impact. In the related technology of spray forming, the deformed droplet has been termed a "splat". Splat dimensions currently used in spray manufacturing are typically 400 micrometers in diameter and 14 micrometers thick originating from a 150 micrometers droplet. In the system of the present invention, the splat size will depend on the droplet speed and viscosity, and will be in the order of a few times the droplet diameter.

The shape and location of the inlet 25 and/or the outlet 24 can be selected to enhance the net form manufacturing. The inlet 25 may include one or more lines and nozzles to direct a gas or vapor stream onto the product being formed for cooling the surface of the product. The inlet 25 could be an annular slot or a series of orifices facing the droplet stream as well as a single opening, and could be used to expose the droplets to a desired environment for cooling, reacting with and/or slowing down the droplet stream in a controlled manner.

Figure 7:
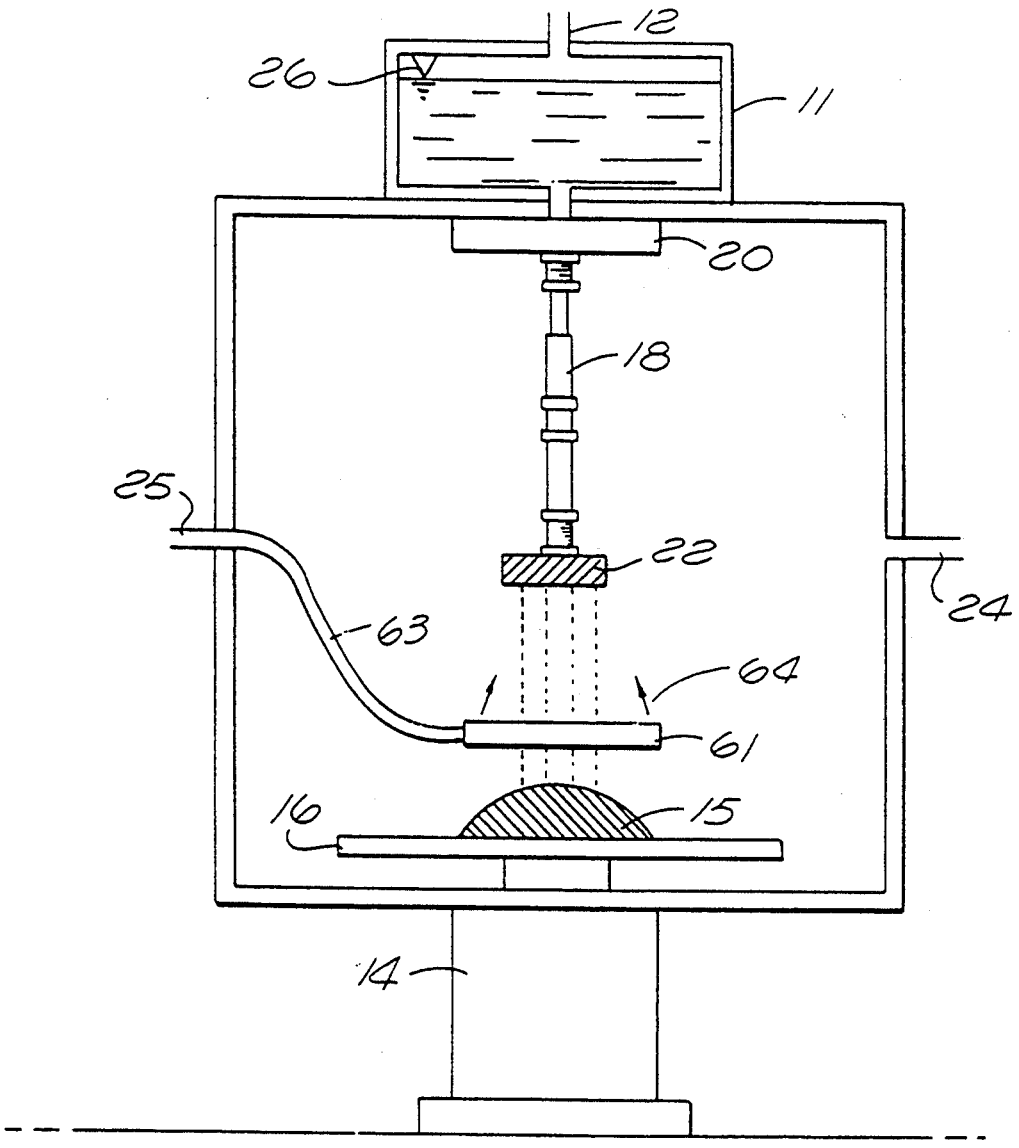
FIG. 7 is a view similar to that of FIG. 2 illustrating another alternative embodiment of the invention using a deceleration gas.
Figure 8:
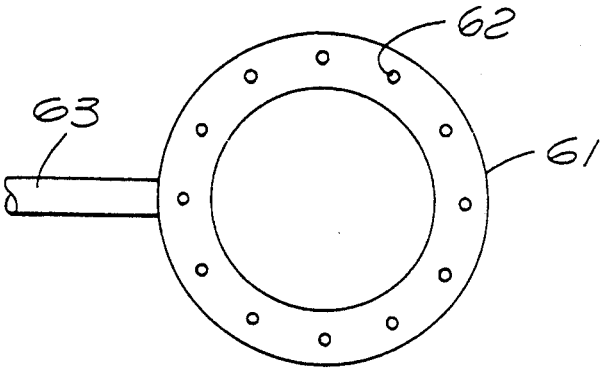
FIG. 8 is a top view of the gas ring of the embodiment of FIG. 7.

One such arrangement is shown in FIGS. 7 and 8. A ring 61 is positioned in the chamber 13 between the generator 22 and the collector 15. The ring is hollow and has a plurality of openings 62 in the upper surface. The inlet 25 is connected to the interior of the ring by a line 63. A gas supply connected to the inlet 25 will provide a plurality of jets 64 of gas directed upward and inward around the droplet stream or streams from generator 22. An annular slot can be used in place of the individual openings 62. The jets 64 can be directed toward the collector as well as toward the generator, or only toward the collector, as desired.

Figure 3:
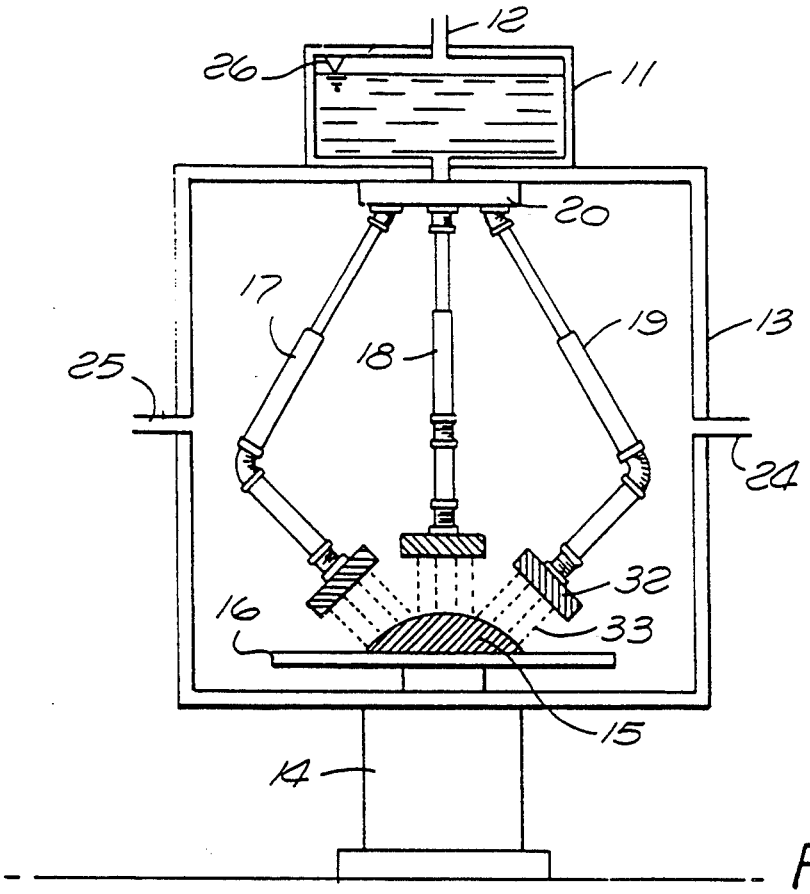
FIG. 3 illustrates an apparatus similar to that of FIG. 2 utilizing multiple stream generators in production of a hemispherical part and incorporating the presently preferred embodiment of the invention.

An alternative embodiment of the invention is shown in FIG. 3, using stream generators 32 each of which produces an array of parallel streams 33.

This embodiment is better suited for making large bulk products. Each array generator may have several hundred nozzles with a separation of five to ten nozzle diameters for maximum material throughput. The angular spread of the array of streams can limit the resolution of the net form product. Current state of the art nozzle array fabrication can produce nozzle arrays with an angular spread in the order of $1\times10^{14\ 3}$ radian.

Figure 4:
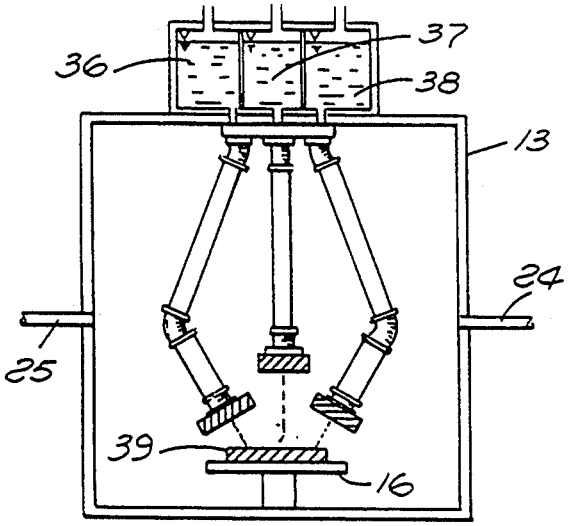
FIG. 4 is a view similar to that of FIG. 2 illustrating an alternative embodiment of the invention utilizing different liquid materials.

Another alternative embodiment is shown in FIG. 4. This embodiment utilizes a plurality of tanks for different liquid materials, three tanks 36, 37, 38 being shown in FIG. 4. Each tank is connected to a separate arm and generator, permitting the application of three different materials in controlled areas of the collector. Also this arrangement with a plurality of material sources can be used for producing alloys, such as aluminum-copper-zinc, nickel-chromium-magnesium, aluminum-silicon and aluminum-copper.

Figure 5:
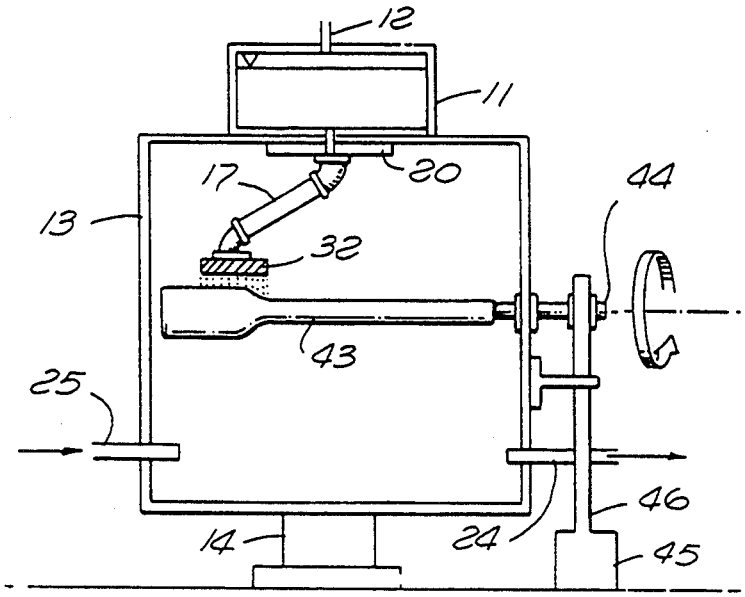
FIG. 5 illustrates another alternative embodiment of the invention suitable for producing products of generally tubular shape.

Another alternative embodiment is shown in FIG. 5. This embodiment is particularly suited for producing tubular products and other products of revolution. A collector 43 is supported on a rotating shaft 44 mounted in the wall of the chamber 13. The shaft is driven by a motor 45 and drive chain or belt 36.

One or more droplet streams are provided from a generator which is moved along the collector as the collector is rotated to produce the product in the desired shape. In all of the embodiments, when the product shape permits, the collector and product can be separated. In other instances, because of the configuration of the finished product, the collector can be removed from the net form product by melting, burning, chemical dissolution or the like.

FIGS. 2–5 illustrate embodiments of the use of precisely controlled droplet streams to net form manufacture parts. Arrays of liquid droplet streams are used to build a part on a collector which can be mechanically translated, in a time dependent manner, to produce complicated forms. The angular dispersion of the droplet stream arrays has been measured to be of the order of $1\times10^{-3}$ radians. The dispersion is due to limitations in currently developed methods of fabricating the nozzle arrays. The angular dispersion of a single stream of droplets has been measured to be of the order of $1\times10-6$ radians. Thus, using multiple streams reduces the dimensional fidelity of the net formed part, although it allows increased material throughput.

FIG. 2 illustrates the use of single streams for fabricating smaller, more refined and intricate parts. The angular dispersion of the stream is of the order of $1\times10^{-6}$ radians. In this embodiment, the resolution is dominated by the splat dimension, i.e., the dimensions of the deformed droplet after surface impact, and can be as good as 50 micrometers. Precise material build up is achieved through motion of robotic arms or the collector or both.

The choice of droplet stream configuration depends on other conditions involved in the manufacturing process. For example, if there are no impurities in the manufacturing environment or liquid material the boundaries of the splats will be obliterated if they impinge on a thin film of material. In this case, uniformly sized drops are desirable so that the droplets have uniform cooling rates, and prevent pre-solidified droplets from impacting on the surface. Droplets which have solidified before impact will retain their identity, and the structure of the net formed material will be porous and inhomogenous. If there are impurities in the ambient environment, then it is desirable to have a distribution of droplet sizes. This is because the impurities cause the splat boundaries to retain their identity, and smaller droplets may be necessary to fill in the interstices of the material. However, the droplets cannot be so small that they have pre-solidified, which leads to a porous and inhomogeneous material. Precise control of the droplet stream configuration is an important feature of the method and apparatus of the invention. In the related technology of spray forming, a spray of molten metal droplets is deposited onto a collector, and precise control of the droplets sizes is not possible, leading to the occurrence of pre-solidified droplets embedded in the material.

The droplet generation of the present invention allows droplet deposition in an ambient environment which is either a vacuum, or a controlled reactive gas for surface conditioning of the deposit. A "vacuum" typically is at least $1\times10^{-5}$ torr. Typical reactive gases include chlorine, bromine, iodine, fluorine, oxygen and hydrogen. The present invention differs from the spray forming technology where the liquid stream is atomized by the use of inert gas which therefore is present in the deposition chamber and is therefore an unavoidable feature in spray forming. The method and apparatus also allows capability of manufacturing variable composition alloys of net form parts, and in-situ formation of composite materials. Resolution as good as 50 micrometers sets the present invention apart from existing technologies of net form manufacturing.

Figure 6A:
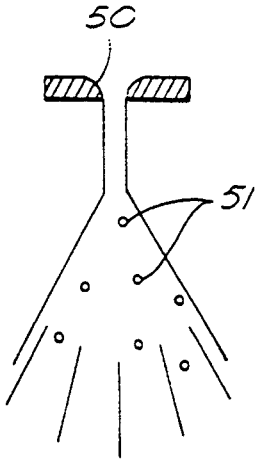
FIG. 6*a*, 6*b*, and 6*c* are diagramatic illustrations of the fluid dynamics of sprays and streams.
Figure 6B:
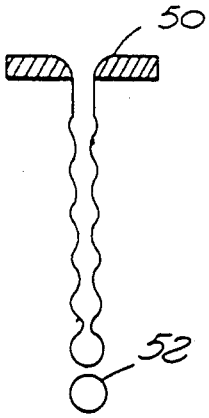
Figure 6C:
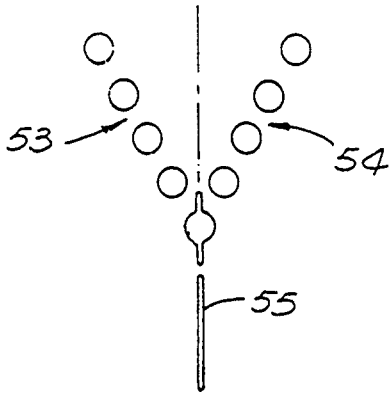

The dynamics of fluid in a space or vacuum environment is illustrated in FIGS. 6*a*, 6*b* and 6*c*. In FIG. 6*a* a stream of high vapor pressure passing through a nozzle or other apparatus 50 tends to bubble and burst into a diverging and uncontrolled cloud of droplets 51 and sometimes frozen particles. This is also the characteristic pattern encountered in spray forming.

Figure 1A:
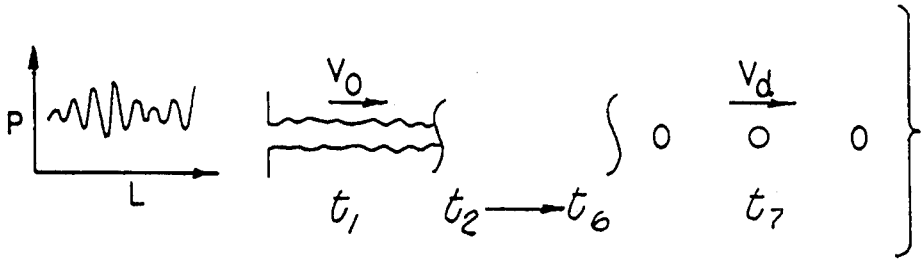
FIGS. 1*a* and 1*b* diagramatically illustrate the break-up and coalescence of an amplitude modulated capillary stream.
Figure 1B:
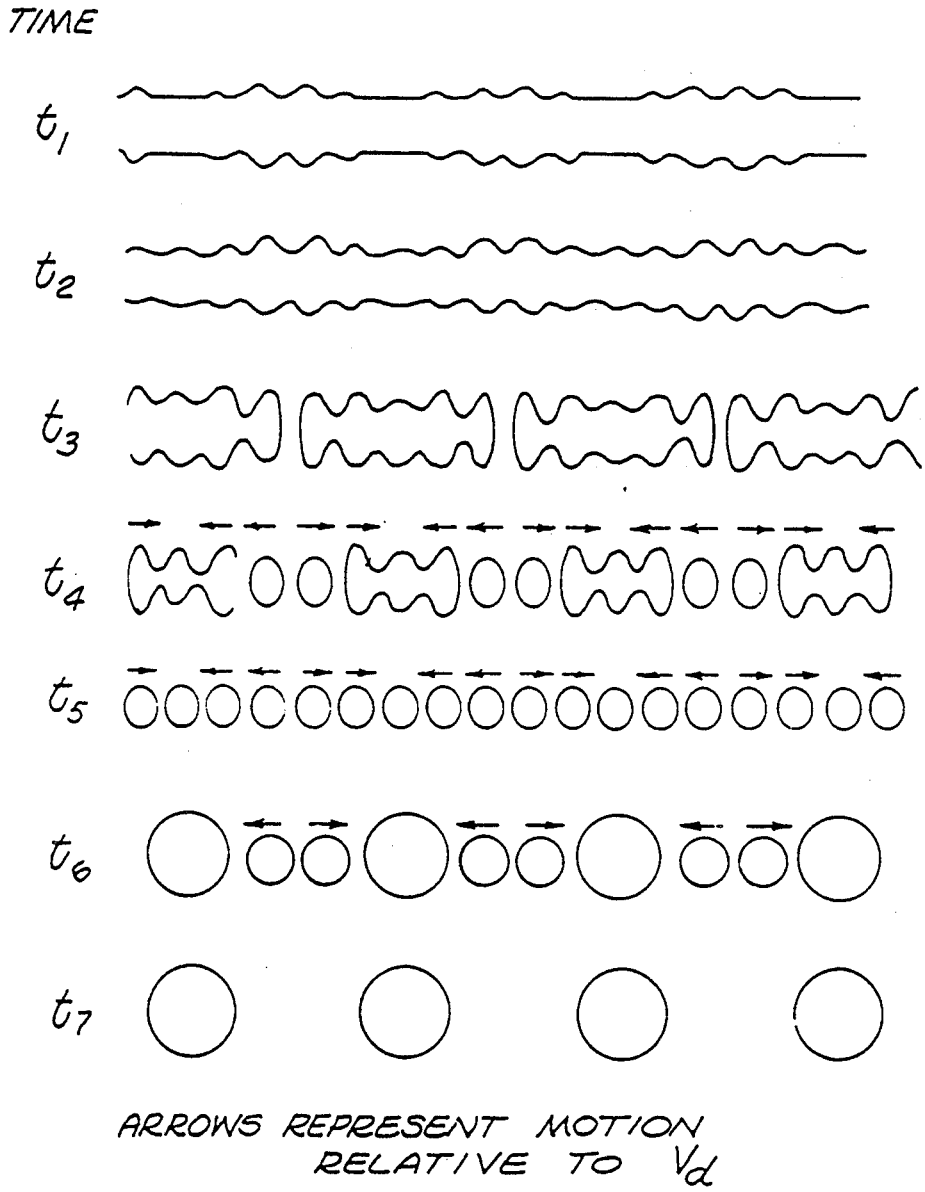

In FIG. 6*b*, a surface tension driven stream of low vapor pressure liquid breaks up into droplets 52 in the manner illustrated in Figs. 1*a* and 1*b*.

In FIG. 6*c*, two droplet streams 53, 54 such as shown in FIG. 6*b*, collide to form flat disks generally perpendicular to the plane of the colliding streams.

Droplet collisions occur in the use of more than one stream of liquid droplets or the use of sprays. It has been found that by removing the effects of aerodynamics (i.e., by operation in a vacuum), droplet collision products are remarkably different than those in background pressures of one atmosphere. Two droplet streams composed of low vapor pressure fluid have been forced to coalesce in a vacuum, as illustrated in FIG. 6*c*. It has been found that if the relative impact velocity of the colliding drops is below a critical velocity, the product of the collision is a flat disk, oriented perpendicular to the pre-collision trajectories and the, center to center vector at contact if impact parameter (distance between line of centers of the Pre-collision droplets) is zero. The fluid disk grows to diameters as large as $1\times10^{3}$ times the disk thickness. The disk then contracts back to a sphere with a diameter commensurate with the volume of the combine pre-collision droplet volumes. On the other hand, if the relative impact velocity is greater than the critical velocity, the thin disk continues to grow in diameter until it ultimately begins to shed fluid ligaments, followed by complete disruption. Collisions in a vacuum result in much thinner disks than can be achieved at background pressures of one atmosphere. It has been found that the impact parameter is an important factor which governs the collision product's shape, size and orientation.

Either the discs can be made to impinge on the surface or if the impact speed of two droplets is above a critical speed (typically in one case about 7 m/s for 200 micrometers diameter droplets of a low vapor pressure oil with a viscosity of 10 c.p.), the discs fragment into a shower of very small "collision" droplets typically $10^{-2}$ of the diameter of the originally colliding droplets. The shower of collision droplets is largely contained within a cone that is defined by the angle of intersection of the two colliding droplets streams assuming the streams have the same speed and same droplet diameter) . The collision droplets take about 10 interdroplet spaces to be created after a collision. Under certain circumstances the spray of extremely fine collision droplets can be used to form a superior deposit due to their small size. Dimensional fidelity can still be good if the collision angle between the droplet streams is 10–20 degrees. Under these circumstances and say for 100 micrometer diameter colliding droplets, the spread of collision droplets is largely contained in a cone with a half-angle of say 10 degrees and thus after 10 droplet spacings (5mm) the radius of the collision droplet spray cone is only about 50 micrometers. The collision droplets in the cone will have diameters around 1 micrometer. If the droplet streams are travelling at say 20 m/s, after collision the time before surface impact need only be about 250 microseconds. In this time the small collision droplets will not cool substantially.

The use of the amplitude modulated sinusoidal disturbance permits stable droplet formation at longer wavelengths or inter-droplet intervals than with an unmodulated disturbance or a single frequency disturbance. Since the controlled collision between droplets results in thin disks with diameters which have been measured to be up to about 20 times the diameter of the original droplet diameter, the fluid disks can overlap and coalesce if the pre-collision streams of droplets are spaced at wavelengths commensurate with that of a conventional single frequency disturbance. The thin disks can be used as an additional diameter control by having individual droplet streams collide before reaching the surface. The close control over droplet speeds made possible by the amplitude modulation and the good directional stability of individual streams permits one to have reliable collisions between droplet streams.

The present invention includes the following features: the use of one or more discrete droplet generators with single or multiple capillary streams that are parallel to $\pm 5$ milliradian in each generator; a means for providing arbitrary disturbances on the surfaces of the streams and for directing each stream; a deposition chamber permitting environmental control, with pressure, type of gas, temperature and gas flow velocity and location all individually controllable; an environmental control system for the deposition chamber; directed deposition onto collectors at rates commensurate with maintaining a thin liquid surface layer on the component; precise control of droplet size permits adjusting cooling rate depending on background pressure and gas type; provision for reactive or nonreactive interactions with background gas, or in benign low pressure environment; use as control parameters, droplet temperature, droplet speed, droplet diameter, length of flight, background gas pressure and type; use of amplitude modulated excitation to control size of droplets, including generation of randomized size distribution; and use of interdroplet collisions to make thin disks before surface deposition.

Advantages of the present invention include: droplet "splats" undergo rapid solidification with high cooling rates; fine grain, low segregation, equiaxial structure with low porosity; enhanced bulk properties; shorter and more direct route from raw material to the finished product; stream which breaks into precisely sized droplets where the size can be controlled over a range of 10 to 1 or so from a single size orifice; droplet streams with speed dispersions as low as $1\times10^{-7}$ times the average droplet speed; angular dispersion of the stream of droplets typically $1\times10^{-6}$ radians; stationary or time dependent stream break-up for precise control of delivery rates; and generation of highly uniform polydispersed or monodispersed droplets at precisely controlled time intervals.

In another embodiment of the invention, method for generating deterministic droplet patterns from capillary stream break-up has been developed. By applying specific amplitude modulated disturbances with an arbitrary modulation to a viscous capillary stream, predictable and flexibly controllable patterns of droplets can be obtained. Specific amplitude modulated disturbances with an arbitrary modulation refers to an amplitude modulated disturbance where the frequency ratio (carrier/modulation) is not an integer. It has been shown that when a capillary stream is disturbed with an amplitude modulated disturbance with an integer frequency ratio, the droplet stream consists of droplets which are more uniformly separated than can be achieved without the modulation. In this embodiment the receptivity of the capillary stream to an amplitude modulated disturbance with a non-integer frequency ratio is disclosed. The droplet sizes and separations can be controlled by selecting the frequency, amplitude, and phase characteristics of the disturbance waveform. The frequency and phase modulations are forms of time dependent modulation.

Droplet stream generation from capillary streams is a well studied phenomenon. Since the late nineteenth century, experimental and analytical studies have sought an understanding of the wave growth on a capillary stream when it is disturbed with a sinusoidal disturbance (which is assumed to be characterized by only one frequency). Over the past two decades or so emphasis has been placed on the nonlinear dynamics of the wavegrowth on the jet. In most previous work, capillary streams were injected into an environment of one atmospheric pressure. Detailed studies of the subsequent droplets were impossible to conduct after they had traveled far from the break-up point because of aerodynamic limitations. In most work, the capillary stream was perturbed with a sinusoidal disturbance. It is known that under such circumstances, droplets will be formed with a separation commensurate with the wavelength of the disturbance. A sinusoidal disturbance with an added harmonic has been used to suppress satellite droplet occurrences.

In recent years, the dynamics of the droplets after they have traveled far from the break-up point have been studied by ejecting the viscous low vapor pressure capillary stream into a vacuum environment so that the disruptive effects of aerodynamics are negligible. Also, waveforms other than single frequency sinusoids have been imposed in a successful attempt to manipulate the droplet stream configuration. In those studies, amplitude modulated disturbances were imposed on the stream. The fast frequency of the amplitude modulated disturbance, or the "carrier" frequency was chosen so that it is in the region of Rayleigh growth and is also an integral multiple of the modulation frequency, i.e., the frequency ratio N, defined as the ratio of the fast frequency to the slow frequency, is an integer. The droplets formed from such a disturbance have been termed "modulation" drops since they are separated a distance commensurate with the modulation wavelength. The speed uniformity of the droplets stream has been found to decrease as 1/N. Thus droplet separations and uniformities which are not possible when perturbing the stream with a conventional sinusoidal disturbance can be achieves by imposing amplitude modulated disturbances. In the course of those studies, it was found that the capillary stream prior to break-up responds to the disturbance in a time of the order of one wavelength the carrier disturbance, and that the capillary stream essentially "mimics" the essential features of the disturbances so that knowledge of the disturbance allows prediction of the break-up characteristics and subsequent droplet properties. The present embodiment of the invention is an improvement on this prior work, using the generation of unique and flexibly controllable droplet stream patterns by applying amplitude and time dependent modulated disturbances, as with non-integer frequency ratios.

When the capillary stream is perturbed with an amplitude modulated sinusoidal waveform, the droplet stream undergoes a unique break-up and coalescence process. To achieve a droplet stream with uniform sizes and separations at extended wavelengths, the disturbance is chosen such that the carrier nondimensional wavenumber is near that of maximum growth rate of the disturbance, and that the carrier frequency is an even multiple of the modulation frequency, i.e., the frequency ratio N, which is defined as the ratio of the carrier to the modulation frequency, is an integer. The stream responds by initially breaking into droplets which are separated a distance commensurate with the fast frequency of the disturbance. While traveling downstream, the droplets from two adjacent half periods of the modulation cycle eventually merge to form one large drop, After initial "carrier droplet" formation the droplets merge in a predictable manner into "modulation" drops. The modulation drops are separated a distance equal to the wavelength of the modulation wavelength. For a frequency ratio of N, a modulation drop is composed of N carrier droplets and the speed dispersions are reduced by a factor of N over carrier droplet speed dispersions. This is one method of generating forcing techniques. This phenomenon is illustrated in FIG. 1. conventional forcing techniques. This phenomenon is illustrated in FIG. 1.

Figure 11:
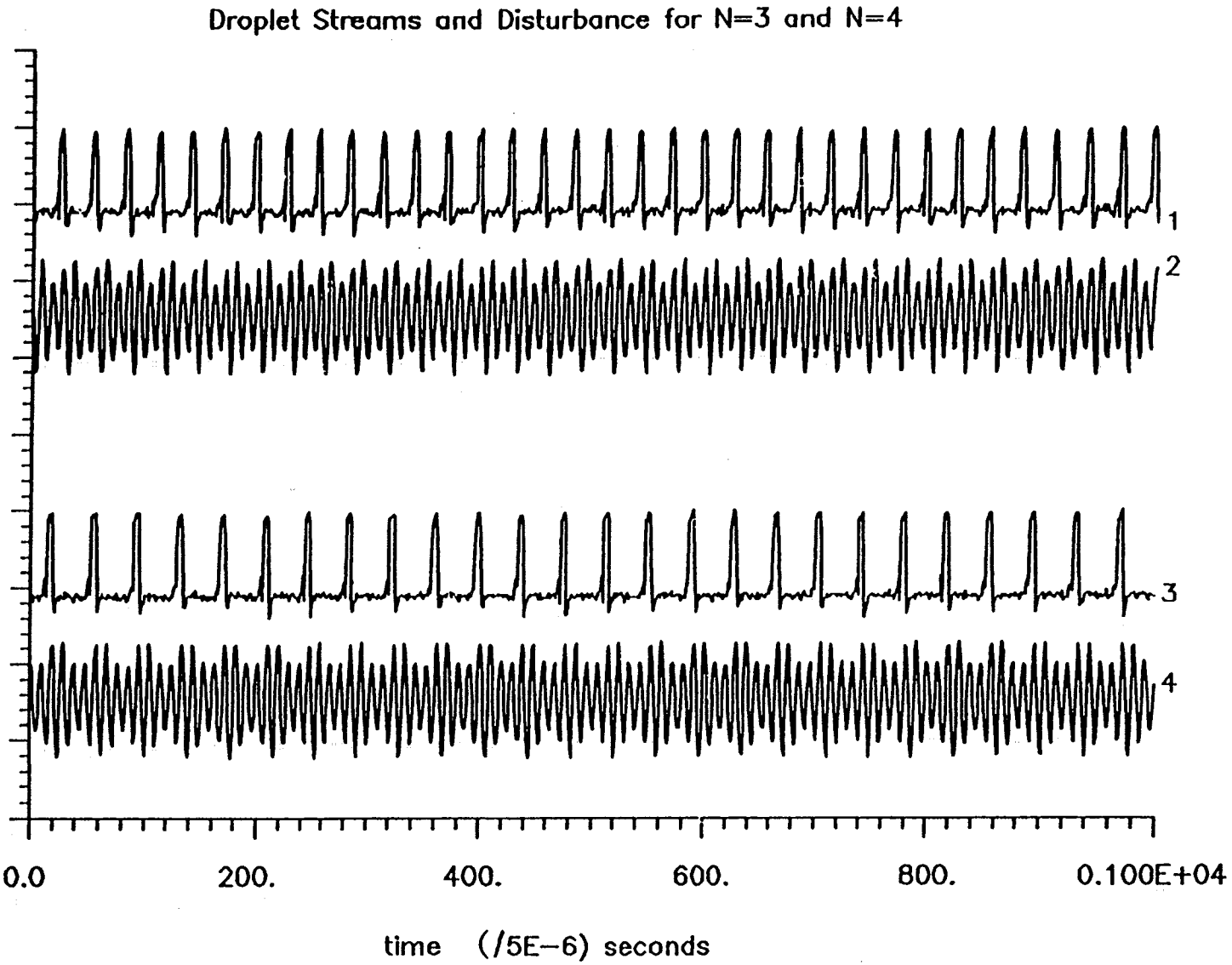
FIG. 11: Droplet stream and corresponding disturbance waveforms. Traces 1 and 2 are modulation drops and disturbance signal with a frequency ratio N =3, traces 3 and 4 are modulation drops and disturbance signal with N =4.

The break-up and coalescence behavior is a consequence of the disturbance waveform. When applying an amplitude modulated disturbance, the radial amplitude on the stream also becomes amplitude modulated. Because of this, the amplitudes of the break points of the potential droplet are not identical at a given time. When the stream breaks to form a drop, there is an impulse exerted on the droplet which is in the direction of the break point. This impulse, which results in a relative speed of the droplet causes the droplets to undergo the coalescence process as they travel away from the break point. FIG. 11 illustrates two streams of modulation drops and their disturbance waveforms. Trace 1 shows the droplet stream which results when a disturbance with a frequency ratio of 3 (shown as trace 2) is imposed on the stream. Likewise traces 3 and 4 illustrate the droplet stream and its disturbance waveform when the frequency ratio is 4. The droplet streams were recorded with an optical probe technique which converts the droplet stream into an analog signal where the peaks represent droplets and the time between peaks represents the time between droplets.

Figure 12:
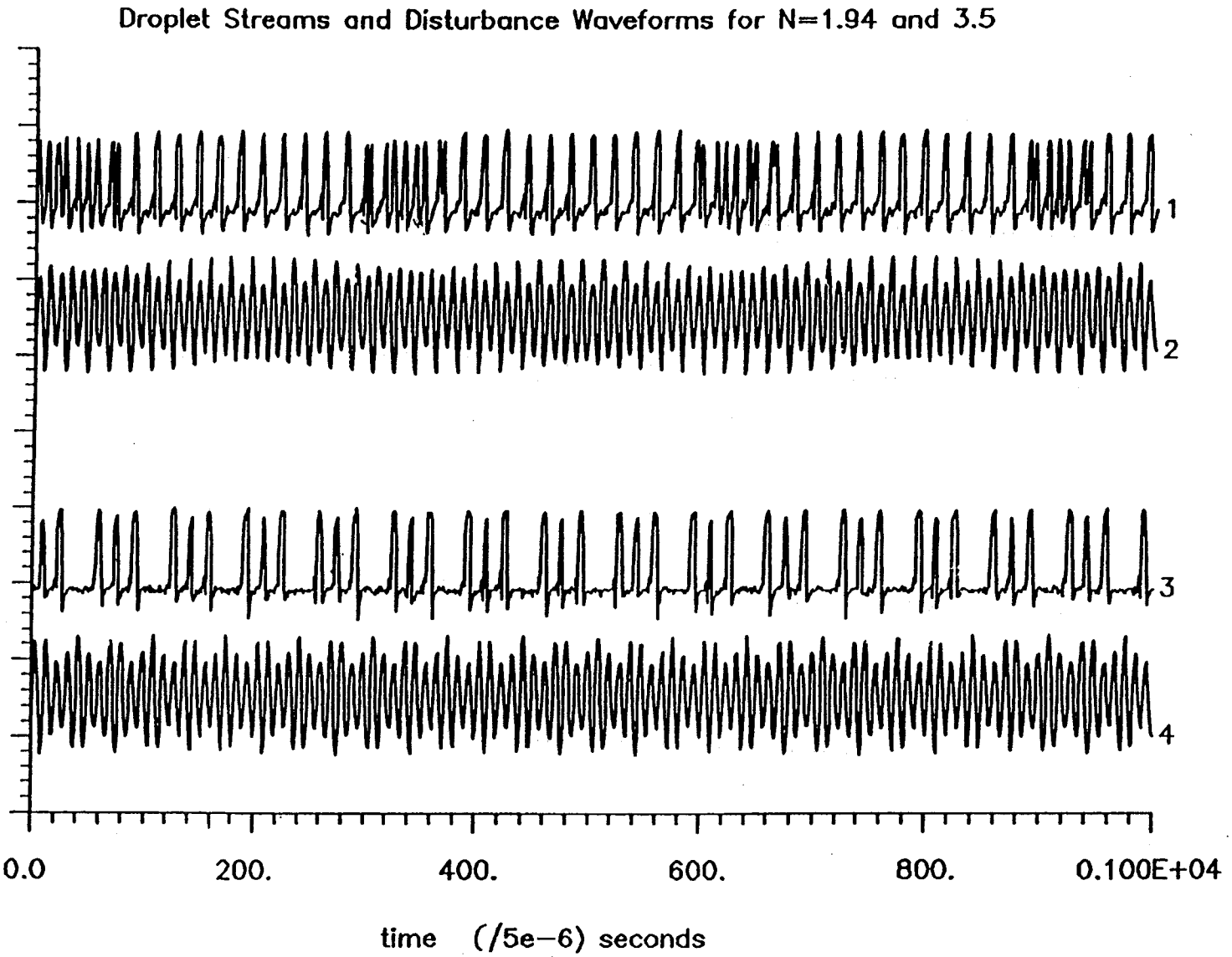
FIG. 12: Droplet stream and corresponding disturbance waveforms. Traces 1 and 2 modulation drops and disturbance signal with a frequency ratio N =1 .94, traces 3 and 4 are modulation drops and disturbance signal with N =3.5.

When the frequency ratio of the disturbance waveform is not an integer, i.e., with amplitude and time dependent modulation a new and different droplet configuration results. Two illustrative examples of the response of a droplet stream to a non-integer amplitude modulated disturbance are shown in FIG. 12. Traces 1 and 2 are the analog representation of the droplet stream and its disturbance waveform with a frequency ratio of N=1.94, and traces 3 and 4 show the droplet stream and corresponding disturbance waveform for N=3.5. With N=1.94, it can be seen that the pattern repeats approximately every nineteen or twenty droplets, and when N=3.5, the pattern repeats every three droplets. To establish the number of carrier modulation drops in a period, the frequency ration, N, is expressed as a common fraction, where the numerator is the number of carrier wavelengths and the denominator is the number of modulation wavelengths in the configuration. A straight-forward example is given in the case of N=3.5, which can be expressed as 7/2. In this case there are seven carrier wavelengths and two modulation wavelengths in each period. Referring to FIG. 12, it is noted that each of the two larger droplets are composed of three carrier droplets, and the small droplet in-between is a single carrier droplet, accounting for seven carrier droplets. In all traces shown in FIGS. 11 and 12 the carrier frequency is 21.3 kHz, the nozzle diameter is 200 μm, the wavenumber is 0.64, and the only parameter that is varied is the modulation frequency. Each trace in FIGS. 11 and 12 contain 1000 points. These represent the first 1k points of records which are up to 128K points long. It is worth mentioning that the remaining record exhibited identical behavior showing long term stability and repeatability.

There are an infinite number of droplet stream patterns that one could conceive of generating. Shown are only two examples which illustrate that stable droplet streams with differently sized and separated droplets can be achieved with fixed generation parameters (nozzle diameter, stream speed, frequencies, etc). The important aspect of this work is that with knowledge of the disturbance waveform, the droplet stream configuration, the droplet separations and sizes in the sequence can be predicted. This is described in the following section.

For the droplet patterns to be useful in their applications, it is necessary to be able to predict and control their configuration based on information of the characteristics of the forcing disturbance (frequencies, phase, and amplitudes).

When a capillary stream which is perturbed with an amplitude modulated disturbance breaks to form a drop, there is an impulse exerted on the drop. The impulse is a result of the asymmetry in the amplitude of the stream at the locations of the break points. The capillary stream essentially "mimics" the important features of the imposed disturbance, thus the asymmetry in the amplitude of the break points is a consequence of the imposed amplitude modulated sinusoidal disturbance. The stream will pinch off first at the location where the streams radial amplitude is a minimum. The radial disturbance will continue to grow until the second break point is achieved. During break-up there is an impulse exerted on the drop which is directed towards the side which was last to break, as if the remaining fluid stream pulls the future drop towards it.

In order to achieve droplet patterns, the frequency ratio, $N=W_c/W_m$, is specifically chosen not to be an integer, where $W_c$ is the carrier frequency and $W_m$ is the modulation frequency. Alternatively, to achieve a droplet stream with uniformity extended separations as described earlier, N is chosen to be an integer. Other pressure disturbances such as frequency modulated, phase modulated, or segmented disturbances with each segment containing different waveform characteristics can also be used to achieve droplet patterns.

Figure 9:
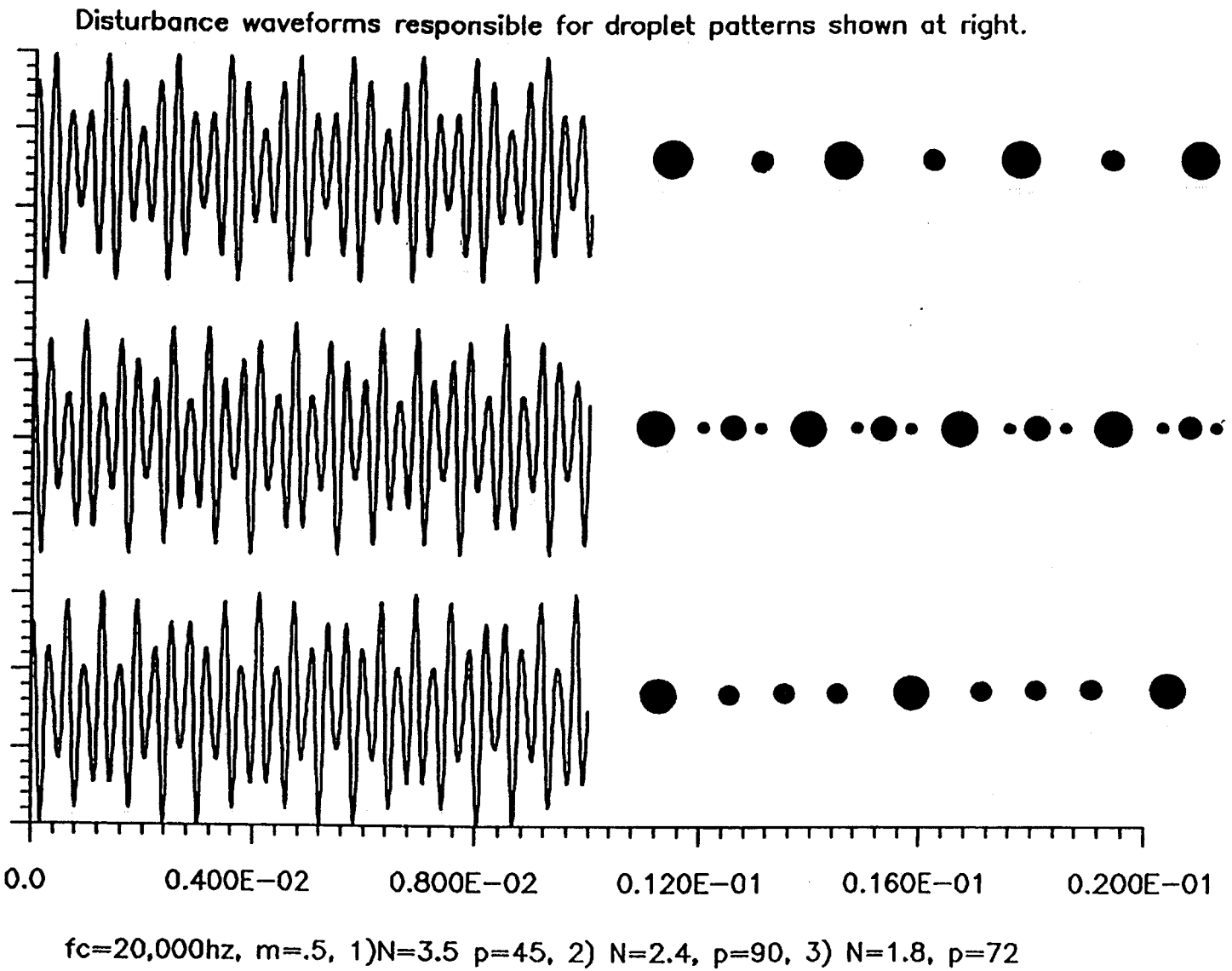
FIG. 9 is a diagram similar to that of FIG. 1 illustrating the droplet formation when using an amplitude and time dependent modulation as the stream disturbance.

Three examples of time dependent droplet formation are shown in FIG. 9. The disturbance waveforms shown to the left are used to generate the time dependent droplet streams shown to the right. Each of the droplet configurations is generated with an amplitude modulated disturbance of a non-integer frequency ratio, N. In all three waveforms the carrier, or fast frequency, is 20 kHz and the degree of modulation is 0.5. In the top waveform the frequency ratio and relative phase are 3.5 and 45° respectively. The droplet stream is composed of equally separated droplets of alternating sizes. The disturbance used to generate the center droplet stream is characterized by N=2.4 and phase=90°. This droplet stream is composed of three differently sized droplets with a pattern of "large-small-medium-small", which repeats at precisely the same intervals. N=1.8 and phase=72° in the lower waveform, and the corresponding droplet stream consists of two differently sized droplets in a pattern represented by "large-small-small-small", which repeats at precisely the same intervals.

The above are only three examples of time dependent droplet stream formation which were generated with amplitude modulated disturbances with non-integer frequency ratios. There are an infinite number of time-dependent droplet stream configurations that are achievable with this embodiment of the invention.

Other types of disturbance waveforms are also possible for use in the generation of time dependent droplet streams. Frequency modulated or phase modulated disturbances will also generate time dependent droplet streams, as well as waveforms which are composed of segments of waveforms which are spliced together. In the latter example, the segments can be composed of traditional sinusoidal disturbances, where each segment can have a different frequency and/or amplitude. Alternatively, the segments can be composed of amplitude modulated, frequency modulated, phase modulated waveforms, or any combination of which (including the aforementioned traditional sinusoid), where each segment contains different characteristics (frequencies, amplitudes, phases, etc.).

Figure 10A:
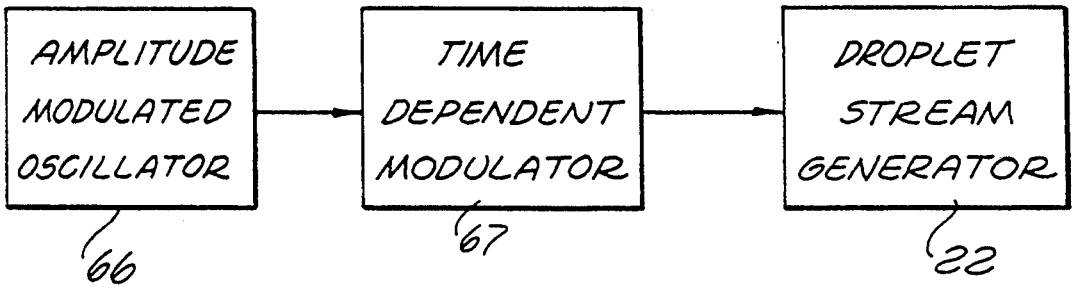
FIGS. 10A and 10B are block diagrams illustrating typical modulator arrangements for a droplet stream generator.

A typical modulator arrangement for the droplet stream generator is shown in FIG. 10A. The output of an amplitude modulated oscillator 66 is connected as an input to a time dependent modulator 67, with the output of the modulator connected as the input to the droplet stream generator 22.

Figure 10B:
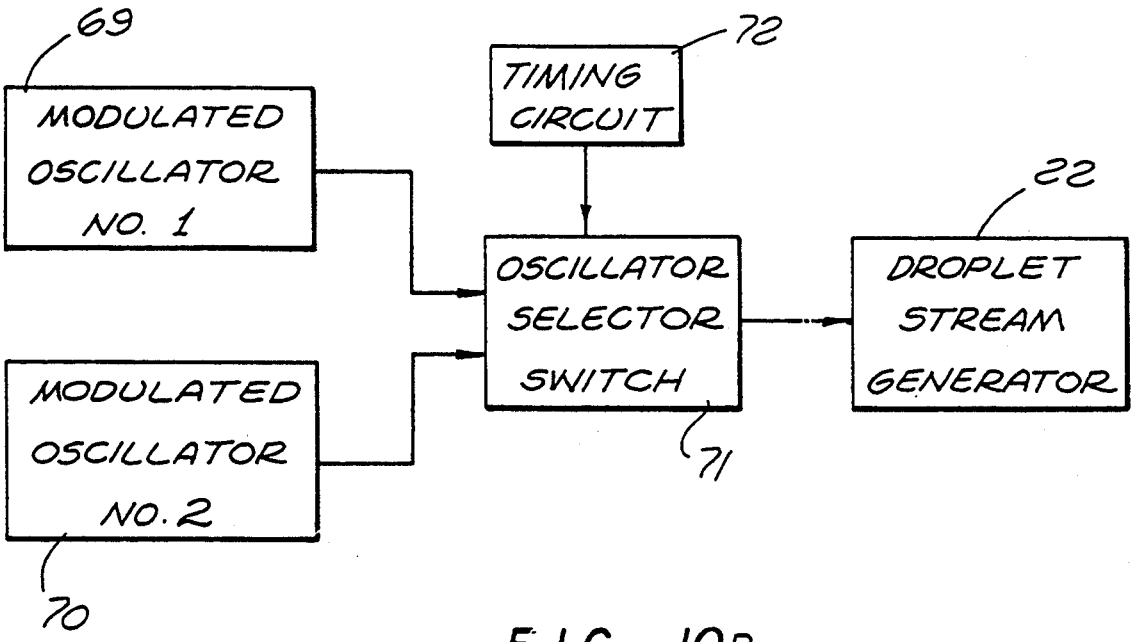

The modulator arrangement for the segmented time dependent system is shown in FIG. 10B. Two modulated oscillators 69, 70, with different outputs are connected to a switch 71 which connects one or the other of the oscillators 69, 70 to the droplets stream generator 22. The switch 71 is controlled by a timing circuit 72 which permits selection of the duration of the segments from the oscillator 69, 70.

It is useful to examine the frequency composition of the droplet stream data-set, x(n), as well as the correlation patterns which may exist. The digitized droplet stream signal is expressed as a data-set x(n), where x is the amplitude and n is the data point in the record. The spectral estimate, $\hat{S}_x(f)$, of the droplet stream data-set x(n) is computed by taking the Fourier transform of the autocorrelation function estimate $\hat{R}_{xx}(m)$, which is given for a stationary random process as $$\hat{R}_{xx}(m) = \frac{1}{N - |m|} \sum_{n=1}^{N} x(n)x(n-m) \quad (1)$$

so that $\hat{S}_x(f) = \mathrm{FFT}[R_{xx}(m)]$.

The spectrum shows the droplet stream's frequency composition, and the autocorrelation function shows the correlation patterns. Since the two are Fourier pairs they contain the same information displayed in the frequency and time domain respectively.

Figure 13:
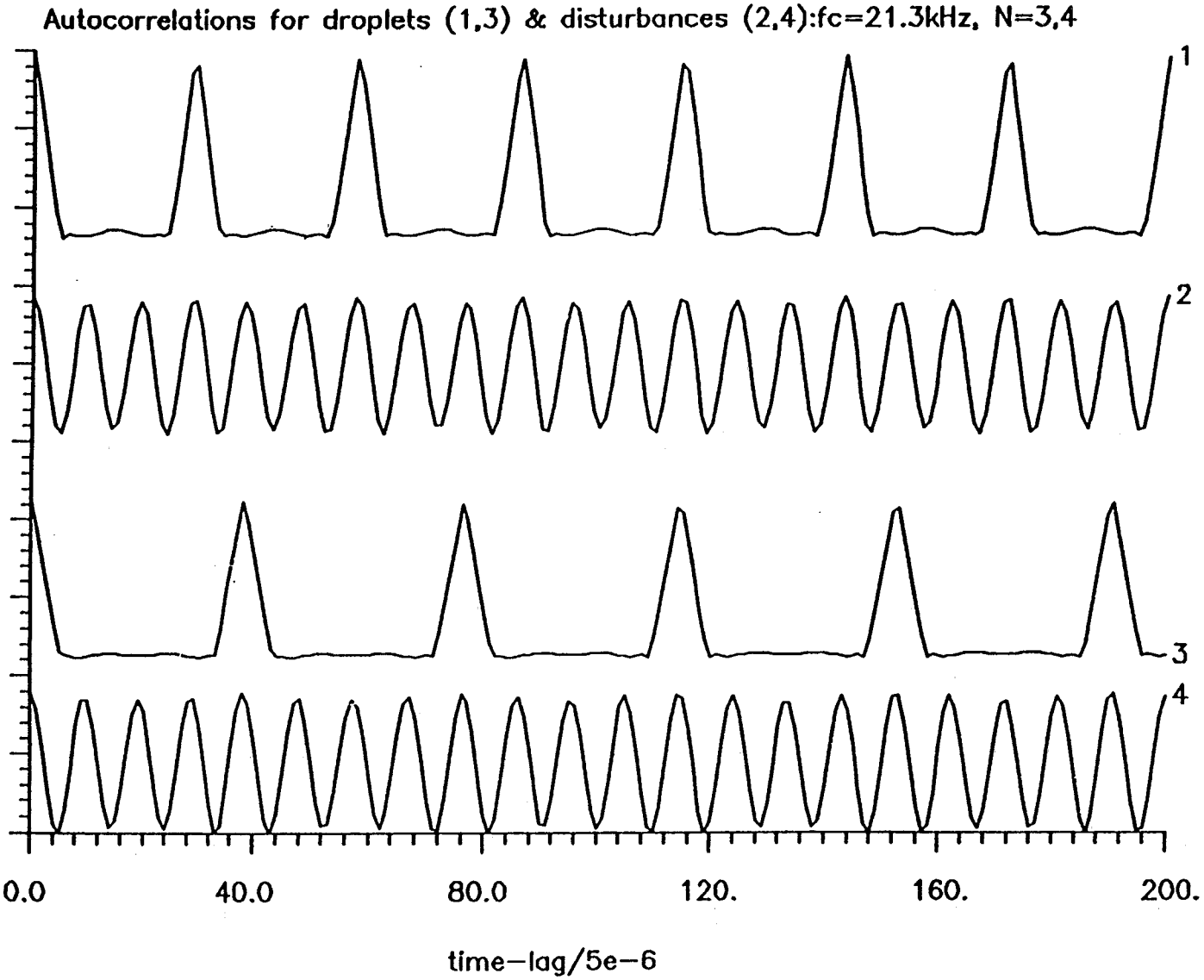
FIG. 13: Autocorrelation functions of the droplet streams (traces 1 and 3) and disturbance waveforms (traces 2 and 4) shown in FIG. 1 where N32 3 (traces 1 and 2) and 4 (traces 3 and 4) respectively.

The autocorrelation $\hat{R}_{xx}(m)$, and autospectrum, $\hat{S}_x(f)$ of droplet traces generated with amplitude modulated disturbances with an integer frequency ratio which were shown in FIG. 11, are examined in order to form a basis for later comparisons with droplet streams generated with arbitrary frequency ratios. FIG. 13 shows $\hat{R}_{xx}(m)$ of the droplet and disturbance traces which have been presented in FIG. 11. In trace 1 which is the $\hat{R}_{xx}(m)$ of the droplet stream generated with a frequency ratio of 3, it can be seen that there is high correlation every 0.14 ms, or every 7100 Hz, which is the modulation frequency and the droplet frequency shown in FIG. 11. Trace 2 is the $\hat{R}_{xx}(m)$ of the associated disturbance waveform shown in FIG. 11. The function shows correlation every 46.9 μs, or every 21.3 kHz, which is the carrier frequency of the disturbance. Similarly, traces 3 and 4 represent $\hat{R}_{xx}(m)$ for the droplet stream and corresponding disturbance for N=4. The droplet stream shows correlation every 0.19 ms, or every 5325 Hz, which is the droplet frequency illustrated in trace 3 of FIG. 11. Also, $\hat{R}_{xx}(m)$ of the associated disturbance (N=4) is shown in trace 4 of FIG. 13. Like that in trace 2 where N=3, the dominate correlation is with the carrier frequency of 21.3 kHz.

The autocorrelation function is also useful for illustrating the noise level of the droplet stream data-set. The amount of noise is indicated by increase in amplitude at a time-lag of 0 compared to amplitudes at other time-lags. In the data shown here, it appears that the noise level is negligible since the amplitude at time-lag=0 is almost identical to that at other time-lags.

Figure 14:
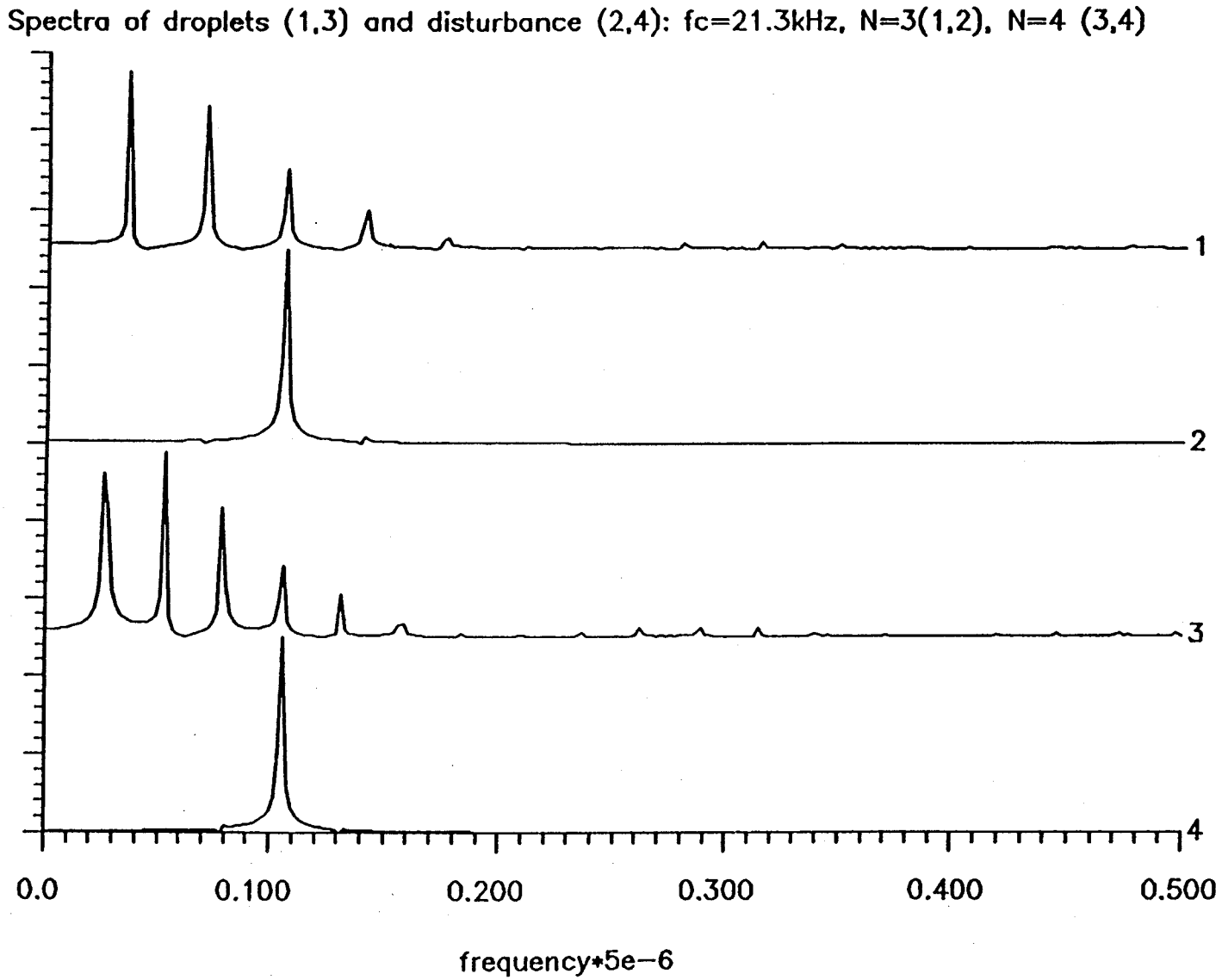
FIG. 14: Spectra of the droplet streams (traces 1 and 3) and disturbance waveforms (traces 2 and 4) shown in FIG. 1 where N=3 (traces 1 and 2) and 4 (traces 3 and 4) respectively.

The spectra of the data-sets shown in FIG. 11 are shown in FIG. 14. Traces 1 and 2 are the spectra of the droplet trace and disturbance waveform for N=3, and traces 3 and 4 are the spectra of the droplet trace and disturbance waveform for N=4. The spectra of the droplet traces (1,3) resemble spectra of half-wave rectifiers which contain frequencies at multiples of the droplet frequency with decaying amplitude. In trace 1, the droplet frequency is 7100 Hz (since the carrier frequency is 21.3 kHz, and N=3), and in trace 3, the droplet frequency is 5325 Hz (since N=4). This result can be explained by reasoning that the droplet trace itself resembles a sinusoidal voltage passed through a half-wave rectifier which clips the negative portion of the wave. The input disturbances shown in traces 2 and 4 show that the fundamental frequency at 21.3 kHz dominates over the sidebands at frequencies of $w_c+w_m$ and $w_c-w_m$.

Figure 15:
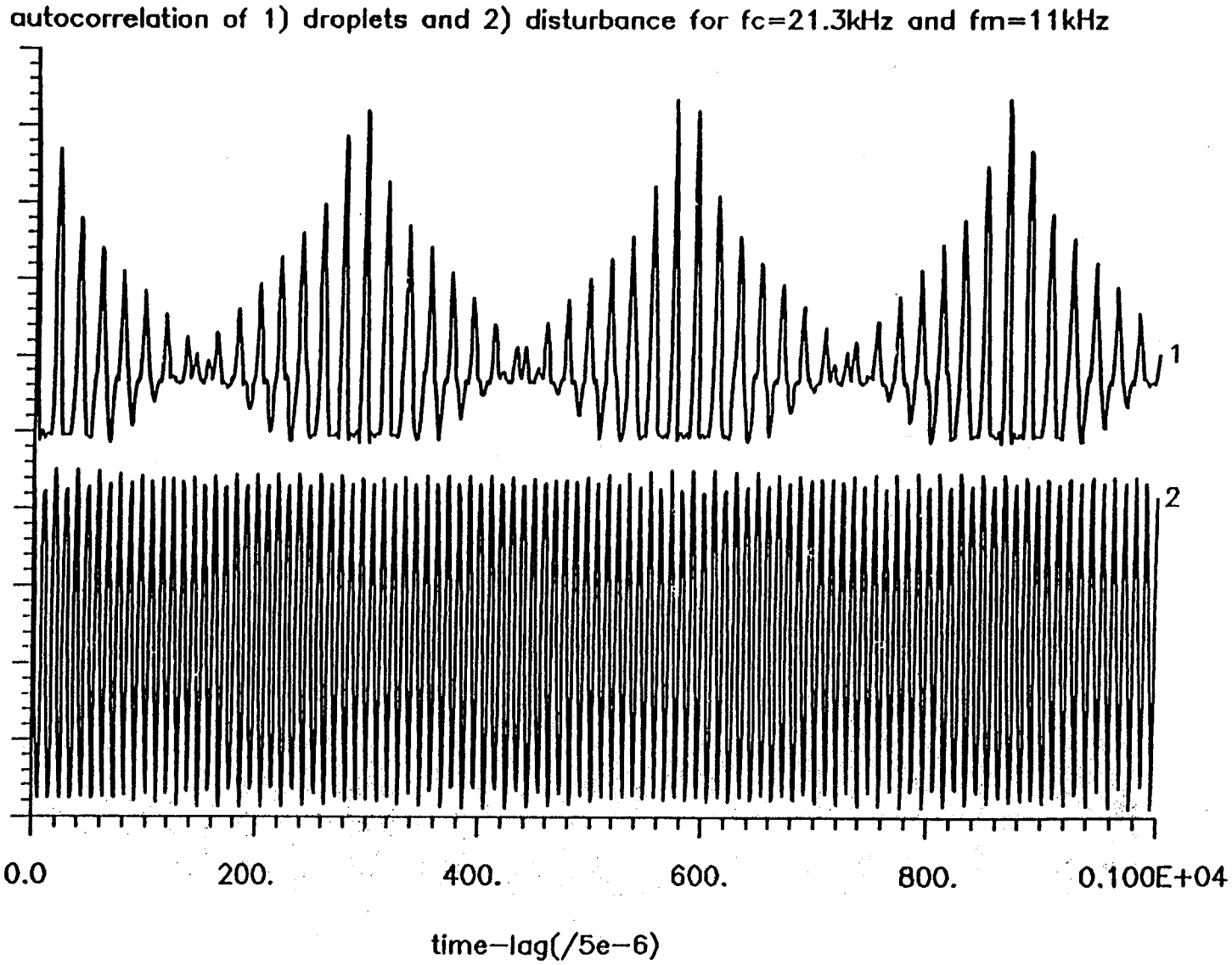
FIG. 15: Autocorrelation function of the droplet stream (traces 1) and disturbance waveform (trace 2) shown in FIG. 2 where N=1.94.

$\hat{R}_{xx}(m)$ and $\hat{S}_x(f)$ of droplet streams generated with non-integer frequency ratios are quite different from those shown above. FIG. 15 shows the $\hat{R}_{xx}(m)$ for a droplet stream generated with N=1.94 (trace 1) and for the corresponding disturbance waveform (trace 2). Referring to FIG. 12, it can be seen that the droplet pattern repeats approximately every 1.5 ms. This is illustrated clearly by $\hat{R}_{xx}(m)$ in FIG. 15. The variation in amplitude is a result of the differently sized droplets. When the droplet trace x(n) is multiplied with itself (time-lag m=0) the correlation is a maximum. Incrementing the time-lag m by 88 μs or so shifts one droplet trace relative to the other by an amount of approximately one droplet so that when multiplying x(n) with x(n−m) the droplet patterns do not overlap precisely, and the correlation decreases. Only after incrementing m by 1.5 ms, two periods of the pattern precisely overlap and the correlation increases again to a maximum. The important feature shown by the autocorrelation function is the repeatability of the droplet pattern. Since $\hat{R}_{xx}(m)$ was formed from a droplet data-set which contained in this case over 30,720 points, $\hat{R}_{xx}(m)$ for lags up to 1024 show a stable, time-independent, droplet stream configuration. As seen previously, the $\hat{R}_{xx}(m)$ of the disturbance waveform is dominated by the carrier frequency of 21.3 kHz.

Figure 16:
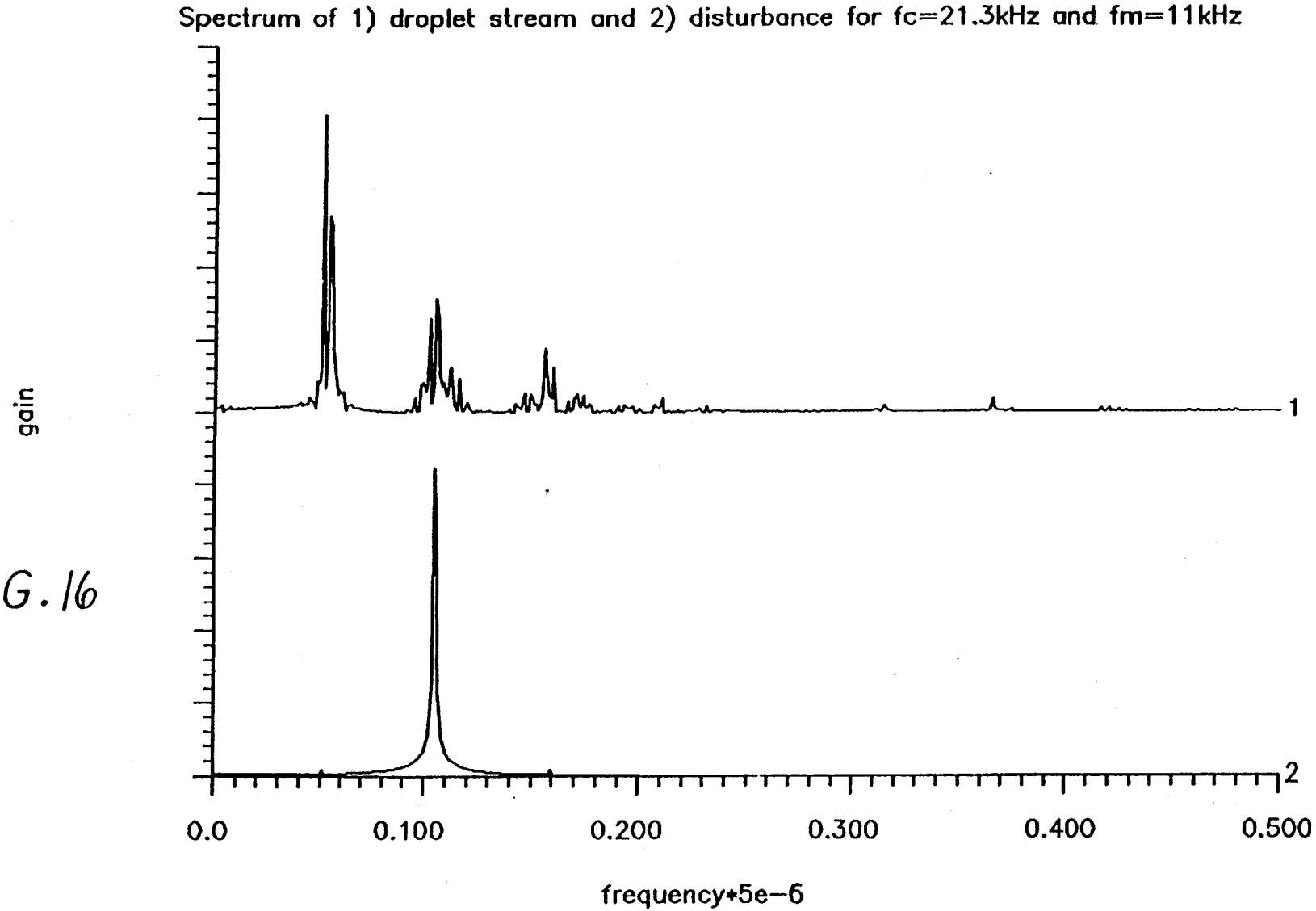
FIG. 16: Spectra of the droplet stream (trace 1) and disturbance waveform (trace 2) shown in FIG. 2 where N=1.94.

The spectral characteristics of the droplet stream with N=1.94 is obtained by forming the FFT of the autocorrelation function and is shown in FIG. 16. Three main frequency components are apparent at multiples of 100000 Hz, which is the fundamental frequency of the droplet signal. Referring to the droplet stream data-set in FIG. 12, the 11 larger droplets are the predominant feature in the waveform, which occur at the frequency of the fundamental. The frequency bands of the fundamental and the Fourier harmonics are more spread than that of the input signal shown in trace 2. The spreading is a consequence of the approximate triangular modulation of the autocorrelation function shown in FIG. 15. However, the power of the triangular modulation is very weak, and is essentially absent in the spectrum. The results of FIGS. 15 and 16 show how the autocorrelation function and the spectra provide different illuminations of the same data-set even though they are Fourier pairs and essentially contain the same information. This example as well as others, illustrates the need for both time-domain and frequency-domain representations.

Figure 17:
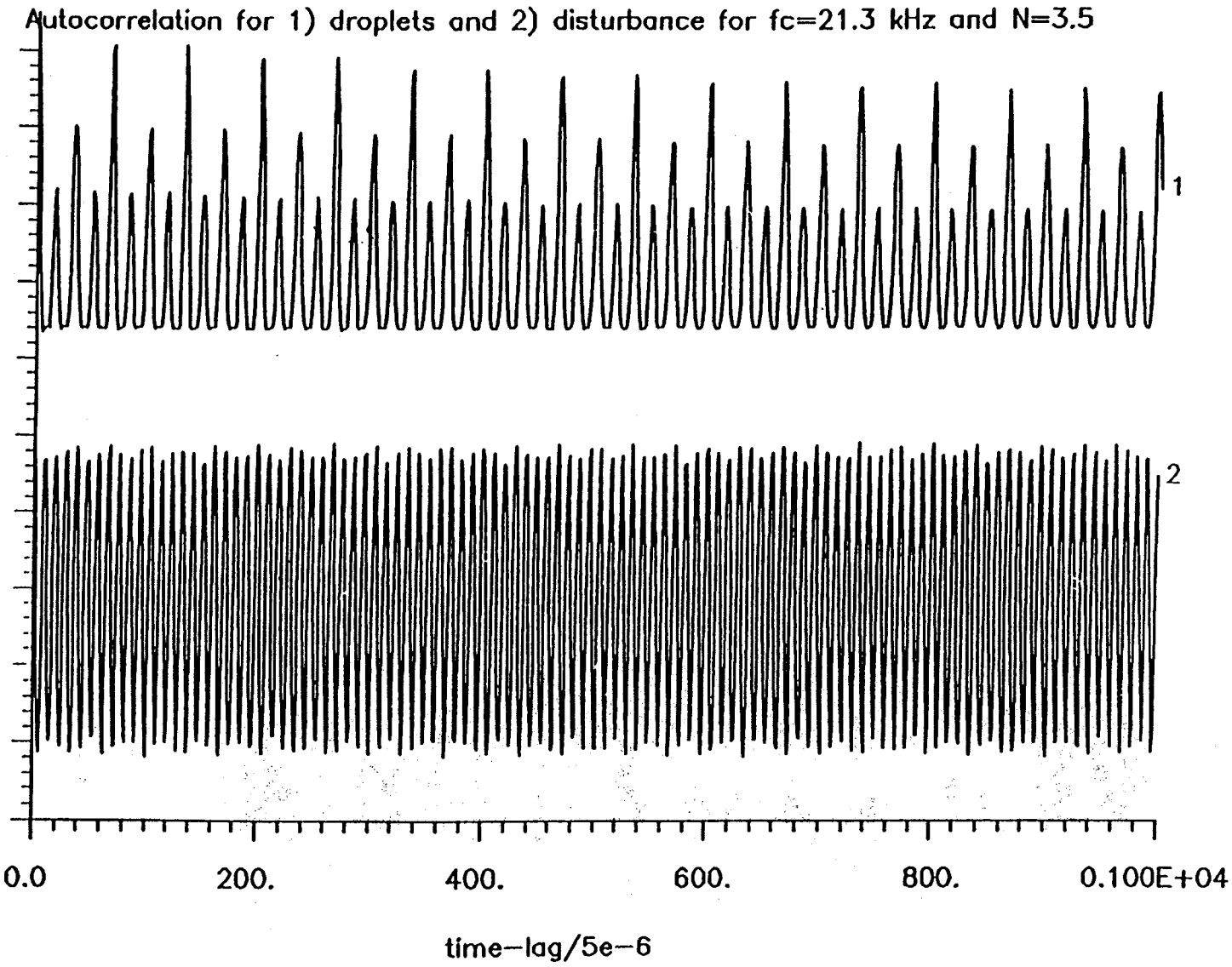
FIG. 17: Autocorrelation function of the droplet stream (traces 1) and disturbance waveform (trace 2) shown in FIG. 2 where N=3.5.

The autocorrelation function of the droplet stream and corresponding disturbance waveform for N=3.5 is shown in FIG. 17. The original data-set has been presented in FIG. 12. Referring back to FIG. 12 trace 3, it can be seen that the pattern of three droplets (large-small-large) repeats every 0.33 ms, or at a frequency of 3050 Hz. This appears in the autocorrelation function as the large spikes occurring every 0.33 ms. As the time-lag m is incremented approximately every 83 μs, droplets from adjacent periods overlap, however the difference in size and spacing reduces the correlation. It is not until the time-lag m is incremented to 0.33 ms that the exact patterns overlap causing a maximum in $\hat{R}_{xx}(m)$. In this case $\hat{R}_{xx}(m)$ was formed with 30720 points with a maximum of 1024 time-lags. $\hat{R}_{xx}(m)$ indicates that the droplet stream patterns are very stable, however there is a slight decay in correlation indicating a non-stationary effect of the droplet stream. This may be explained by a minute drift in overall droplet speed due to a non-constant stagnation pressure. Again, the $\hat{R}_{xx}(m)$ of the disturbance waveform is dominated by the carrier frequency of 21.3 kHz.

Figure 18:
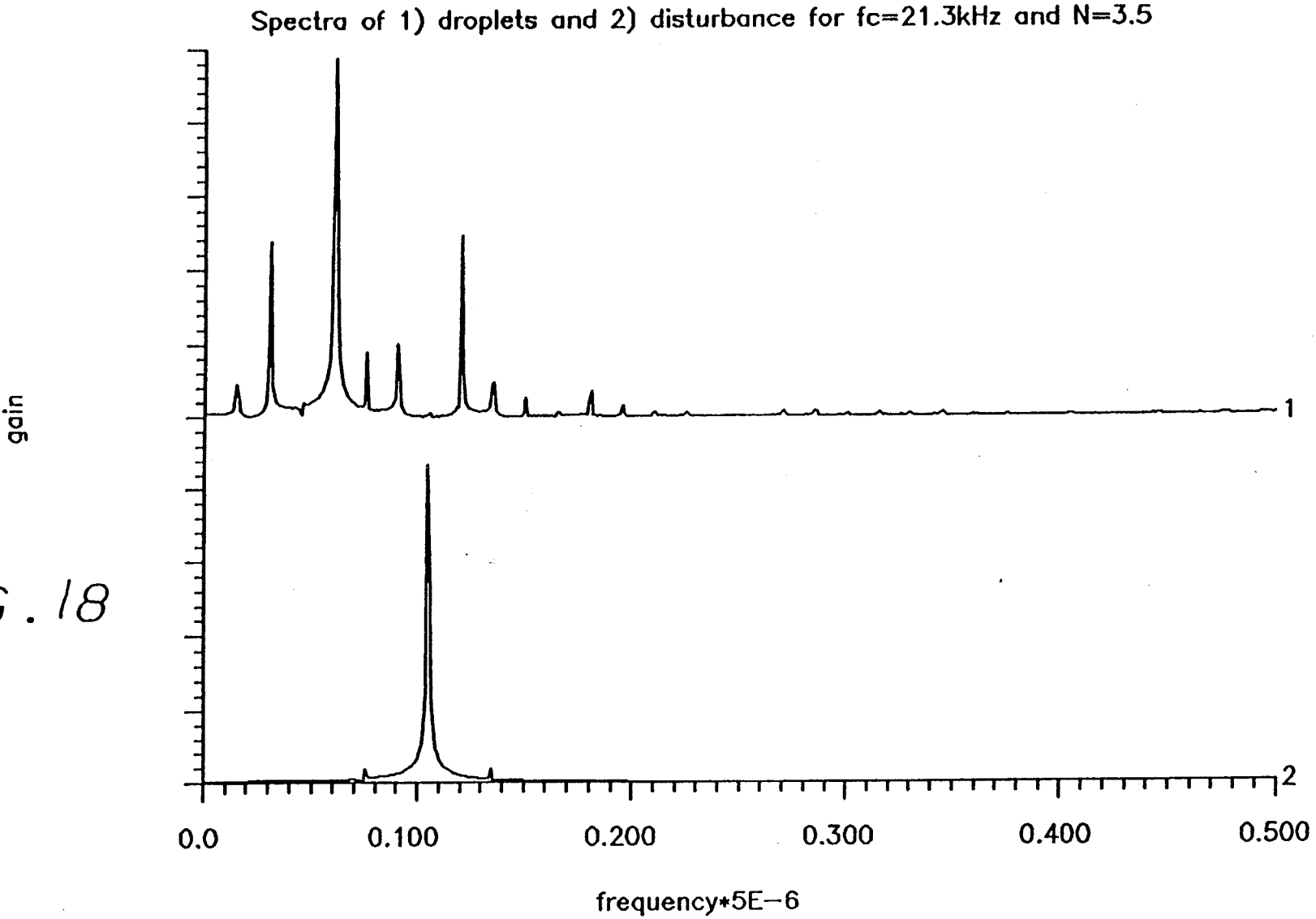
FIG. 18: Spectrum of the droplet stream (trace 1) and disturbance waveform (trace 2) shown in FIG. 2 where N=3.5.

The spectra of the droplet stream and corresponding disturbance waveform generated with a carrier frequency of 21.3 kHz and a frequency ratio N of 3.5 are given in FIG. 18. The spectrum of the disturbance waveform shown in trace 2 is straightforward and shows the carrier frequency dominating the two sidebands at frequencies of $W_c+w_m$ and $w_c-w_m$. The spectrum of the droplet stream is more complicated, as it illustrates the fundamental frequency of 3050 Hz which is the period of the repeating droplet pattern. The other frequency components are the Fourier harmonics since they are separated by multiples of the fundamental frequency. It can be seen that the seventh harmonic, which is approximately the forcing frequency is essentially absent, as the droplet stream has undergone a merging process which has erased information about the original forcing and break-up. The third harmonic component centered at 12.2 kHz corresponds to the frequency of the large-small-large group. One can interpret this droplet stream by noticing that there if there was an additional droplet between the group of three droplets (large-small-large), then all the droplets would be generated at an approximate frequency of 12.2 kHz. This is the reason for the maximum gain at 12.2 kHz. The second harmonic at 6.1 kHz is due to the large droplets which are all uniformly separated.

Figure 19:
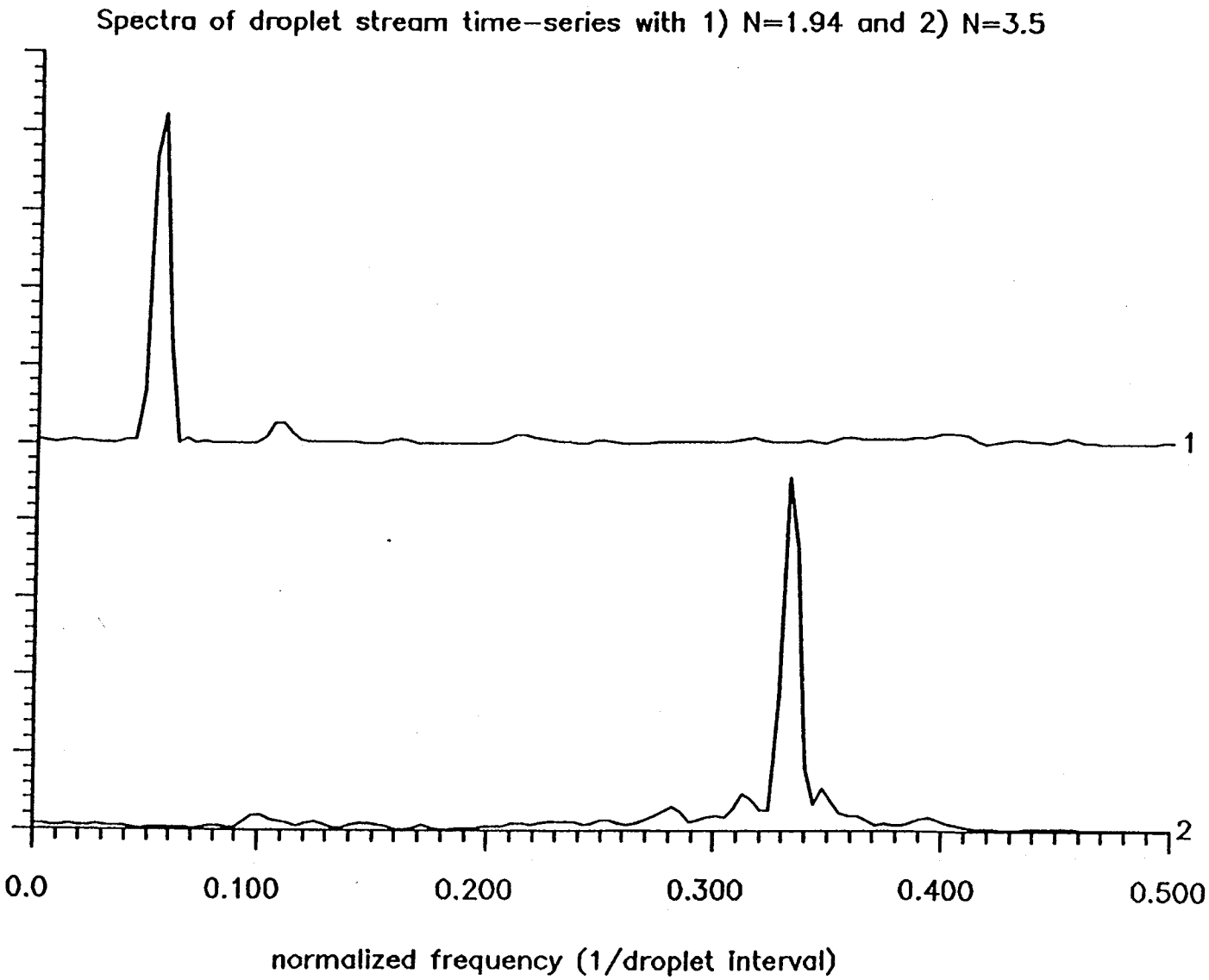
FIG. 19: Spectra of the inter-droplet interval time-series with N=1.94 (trace 1), and N =3.5 (trace 9).

The periodicity is easier to see of the droplet stream data-set is converted into a time-series data-set of inter-droplet spacings. The disadvantage associated with performing the conversion is that the droplet size information is lost, and only separation information is maintained. Since the results are useful for subsequent comparisons, the $\hat{S}_x(f)$'s are shown below for the droplet streams generated with N=1.94 and 3.5 as described above. To interpret the results of the spectrum, the abscissa is the normalized frequency, which is the inverse of droplet interval. Trace 1 of FIG. 19 has a peak at a normalized frequency of 0.052. This means that the droplet pattern repeats every 19 or so droplets, which was previously observed. Trace 2 in FIG. 19 is the spectrum of the time-series with N=3.5. The peak in power occurs at a normalized frequency of 0.33. This means that the droplet pattern repeats every three droplet intervals, or every three drops. Referring to FIG. 12, the droplet pattern clearly repeats every three droplets.

Figure 20:
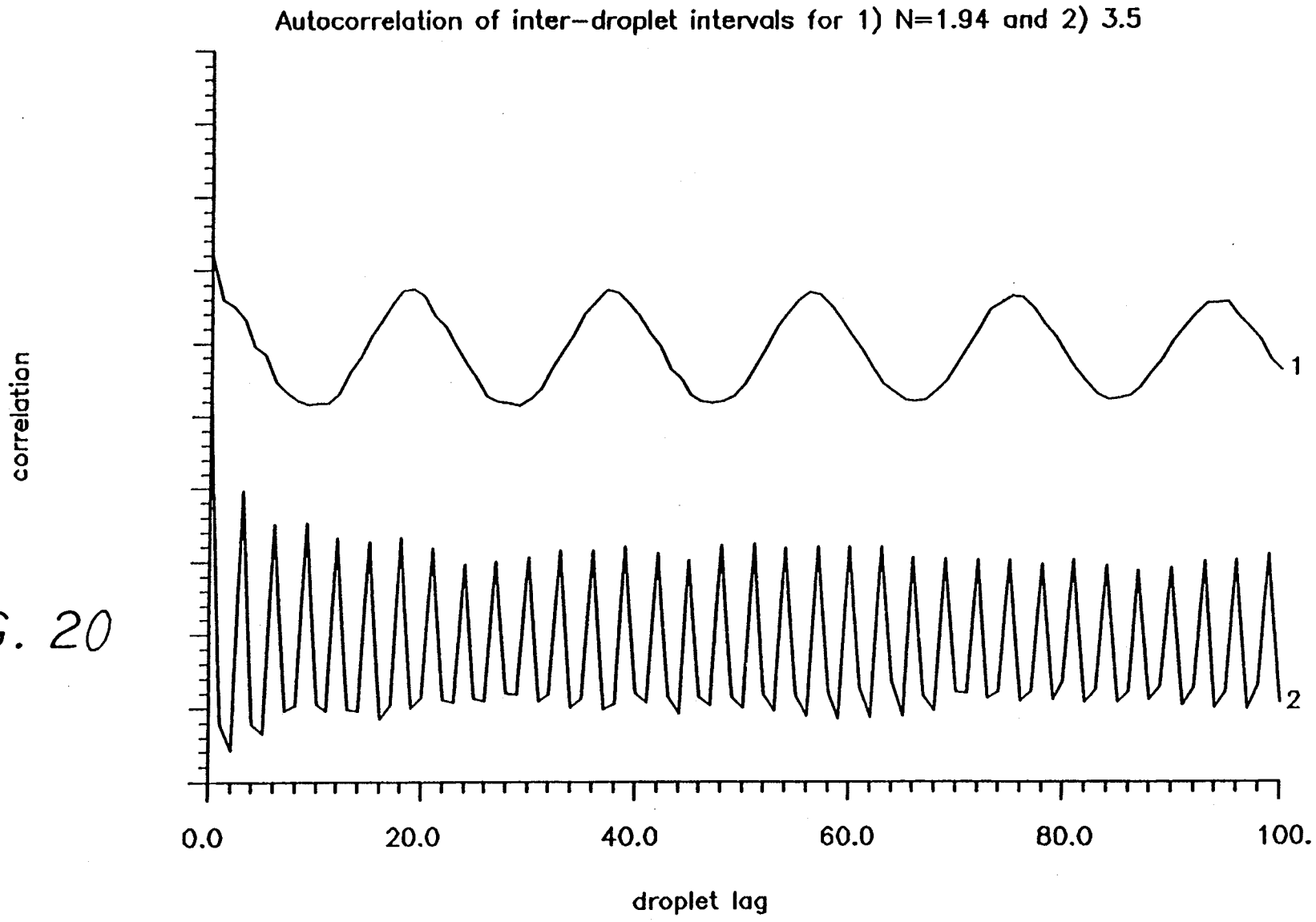
FIG. 20: Autocorrelation of the inter-droplet interval time-series with N=1.94 (trace 1), and N=3.5 (trace 2).

The time domain representation is given below in FIG. 20 where trace 1 shows $\hat{R}_{xx}(m)$ for N=1.94 and trace 2 for N=3.5. The abscissa is the droplet interval lag. In trace 1, significant correlation occurs every 19 droplets which is consistent with the frequency domain result. Trace 2 represents $\hat{R}_{xx}(m)$ for N=3.5. It can be seen that $\hat{R}_{xx}(m)$ peaks every 3rd droplet lag, in agreement with the frequency domain result. Thus, analysis of the time-series representation of inter-droplet intervals illustrates clearly the periodicity of the droplet patterns generated with amplitude modulated disturbances with arbitrary modulation. The disadvantage with this representation is that the droplet size information is lost.

Two examples of droplet streams generated with amplitude modulated disturbances of non-integer frequency ratio have shown the periodic behavior of the resulting droplet patterns by spectral analysis. The two examples that were shown were chosen arbitrarily and are representative of a larger set of unusual droplet patterns which have been generated in experiments and illustrate similar periodic consistency by spectral analysis. There are an infinite number of droplet patterns that one could conceive of generating which would show precise periodicity. There is a requirement for the ability to predict and reproduce the pattern based on the disturbance waveform characteristics in order for the conceived droplet pattern to be useful in it's application. This requirement is satisfied with the model described earlier, whose results are given below.

Figure 21:
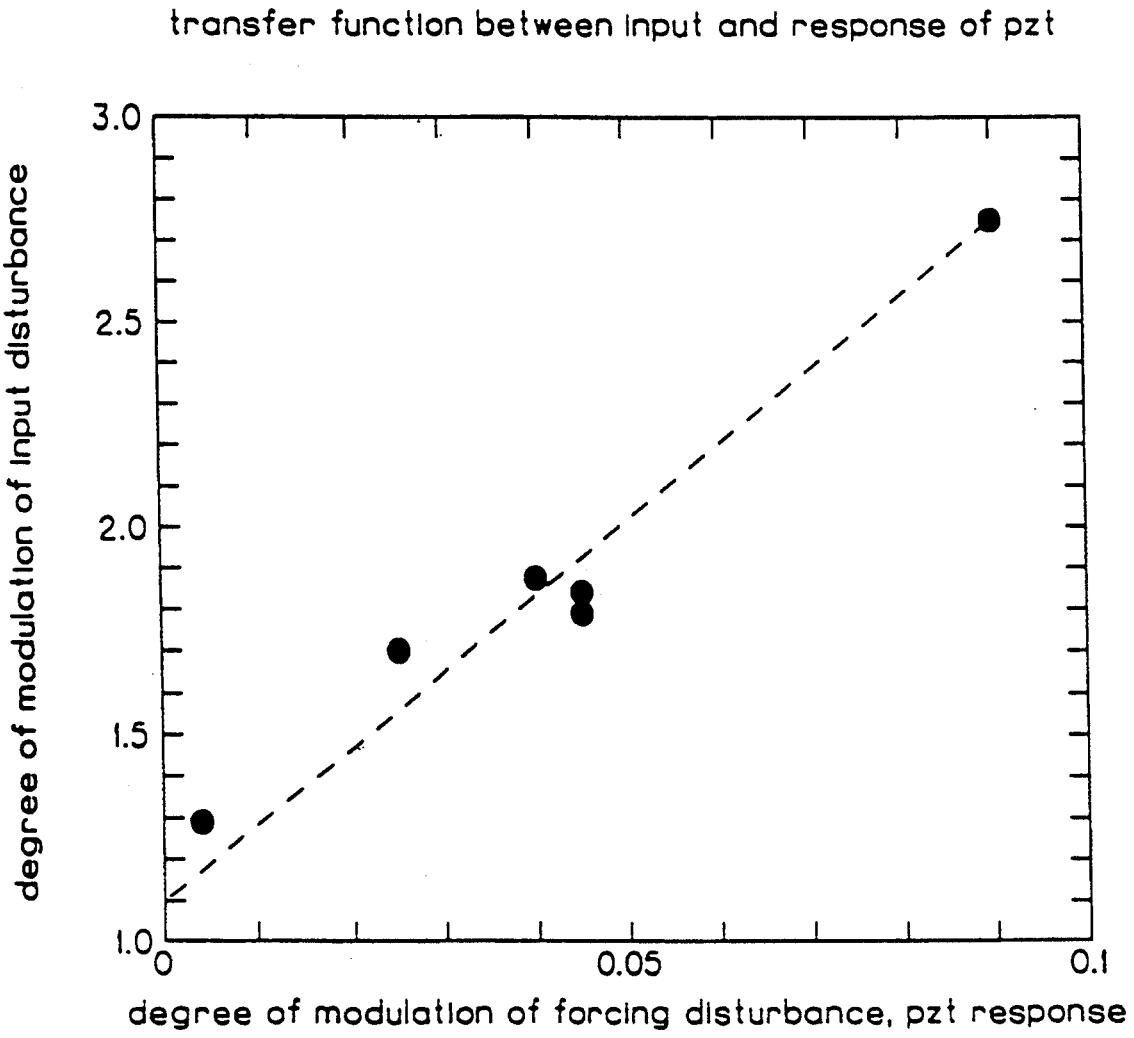
FIG. 21: Transfer function between experimental and predicted degree of modulation m

The disturbance waveforms used in the model duplicated the disturbances used in experiment in that the frequencies and their phase relationship were identical. However the degree of modulation, m, used in the model was different than that used in the experiment. This is because the amplitude modulated disturbances which are shown in FIGS. 11 and 12 (traces 2,4) are the input disturbances from the function generators to the piezoelectric crystal (PZT), and not the actual forcing disturbance which initiates the streams radial growth which is assumed in the model. The response of the PZT to an input signal cannot easily be measured with the nozzle configuration employed. To overcome this obstacle, a transfer function between the input disturbance to the PZT and its response, which is the streams forcing disturbance, was obtained empirically with the use of the predictive model. By using a forcing disturbance in the model with the same frequencies and phase relationship as the input disturbance in the experiment, the degree of modulation m of the forcing disturbance in the experiment can be estimated by adjusting the degree of modulation m in the model until the experimental configuration is obtained. It has been found that there exists a linear relationship, as shown in FIG. 21 between the input disturbance to the PZT and its response, i.e., the forcing disturbance. This transfer function was subsequently used to obtain comparisons between experimental and predicted droplet patterns.

Figure 22:
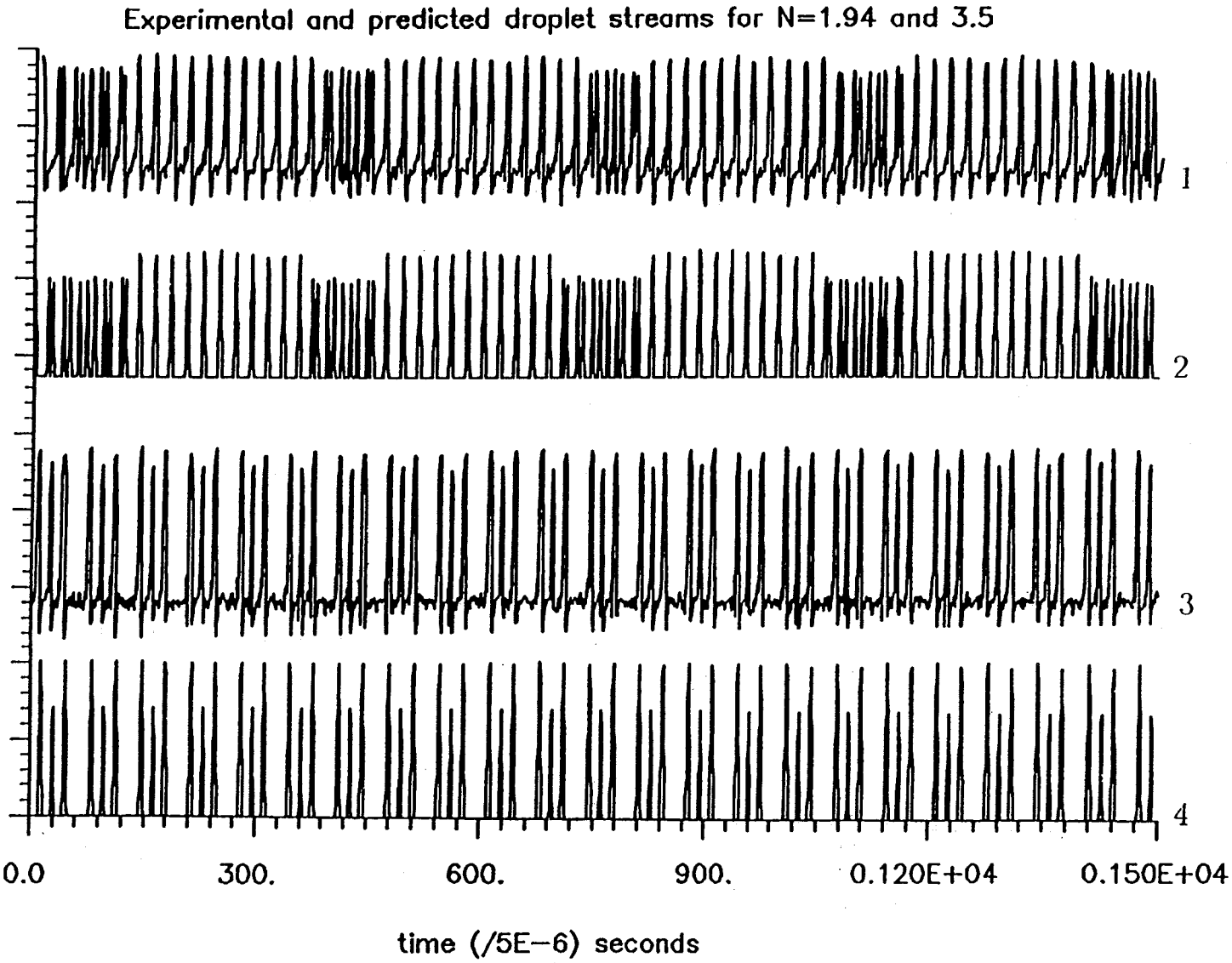
FIG. 22: Experimental droplet patterns (1,3) and predicted patterns (2,4) for N=1.94 (1,2) and N=3.5.

Traces 1 and 2 of FIG. 22 illustrate the experimentally obtained droplet stream and the predicted droplet stream for N=1.94. Traces 3 and 4 illustrate the experimental and predicted droplet streams for N=3.5. The peaks representing the droplets in the predicted waveforms were approximated with a triangular fit where the heights and widths correspond to the size of the droplet. The shape of the experimental curves are more complicated since they result from the passage of the magnified shadow image of the droplet over a slit in front of a photomultiplier tube. The predicted droplet traces are intended to serve as a visual demonstration of the droplet stream patterns, where the droplet sizes and separations can be used for comparisons with the experimental patterns. It is evident that the predicted patterns are in good agreement with the experimental droplet patterns.

In both of the predicted configurations (traces 2 and 4) the heights of the peaks give an accurate measurement of the relative droplet diameters. The experimental traces (traces 1 and 3) measure the droplet diameter indirectly, since the actual measured value is relative intensity received by the photomultiplier tube. Varying the slit length or width with respect to the average drop diameter will effect the relative heights of the droplet signal. However, by knowing the signal levels of full light and complete shadow, this method can be used to extract the droplet sizes.

Figure 23:
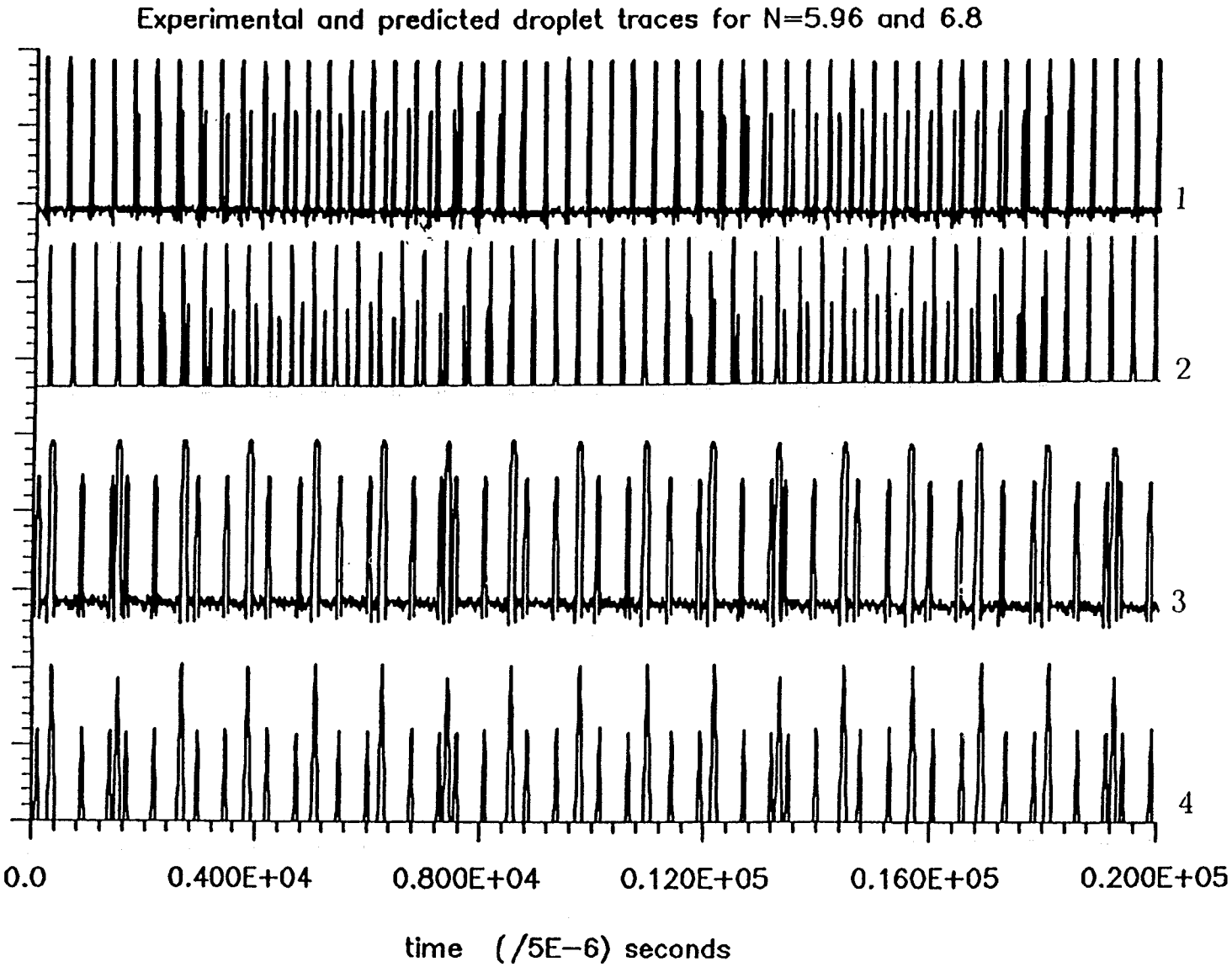
FIG. 23: Experimental droplet patterns (1,3) and predicted patterns (2,4) for N=5.96 (1,2) and N=6.8.

Two additional examples of droplet pattern generation by capillary stream break-up are shown in FIG. 23. Traces 1 and 2 are the experimental and predicted droplet patterns respectively for N=5.96, and similarly traces 3 and 4 are that for N=6.8. When N=5.96 the pattern consists of 44 droplets, and when N=6.8, the pattern consists of 15 droplets. The predicted droplet traces both contain two droplet diameters. Variations in heights of the small or large droplets arise due to a sampling interval which was not short enough to define the peak of the droplet signal. Also, in the experimental traces, the undershoot is optical noise, presumably arising from the inevitable accumulation of oil vapor on the optical access ports during the course of running the experiment. The predicted droplet signals are free of the experimental noise. These examples demonstrate the agreement between experiment and prediction.

The presented examples illustrate the predictably of the droplet configuration based on knowledge of the input disturbance. The repeatability of both the experimental and predicted droplet patterns are examined with the autocorrelation and spectral analysis. To compare spectra between experiment and prediction, it is necessary to convert both signals into time-series datasets of inter-droplet intervals. Such a conversion erases the droplet size information, however as mentioned previously it is not appropriate to compare absolute droplet sizes between experiment and prediction. This will allow the periodicity in separations is seen more clearly.

Figure 24:
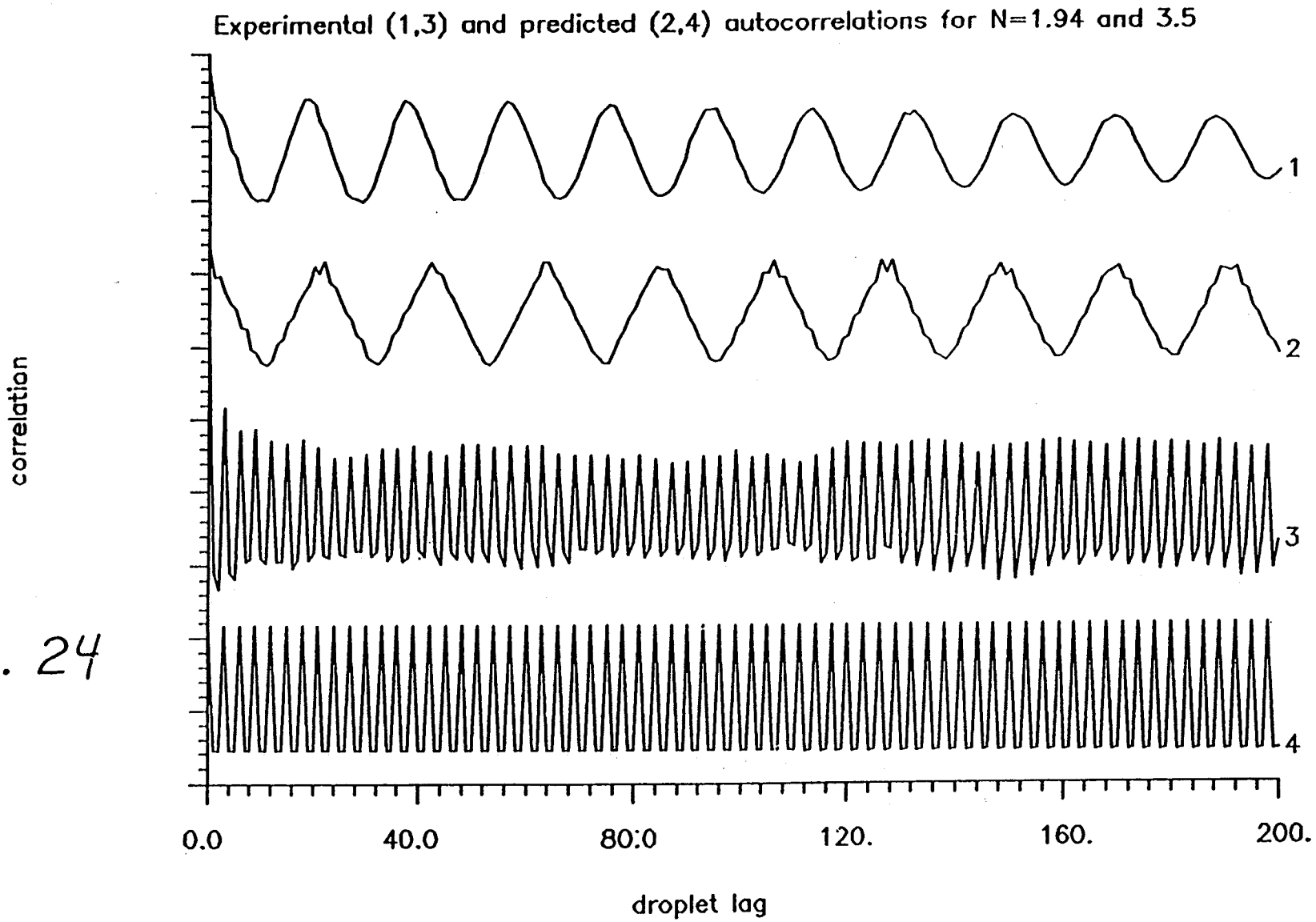
FIG. 24: Autocorrelation function of experimental (traces 1,3) and predicted (traces 2,4) time-series droplet stream with N=1.94 (traces 1,2) and 3.5 (traces 3,4).
Figure 25:
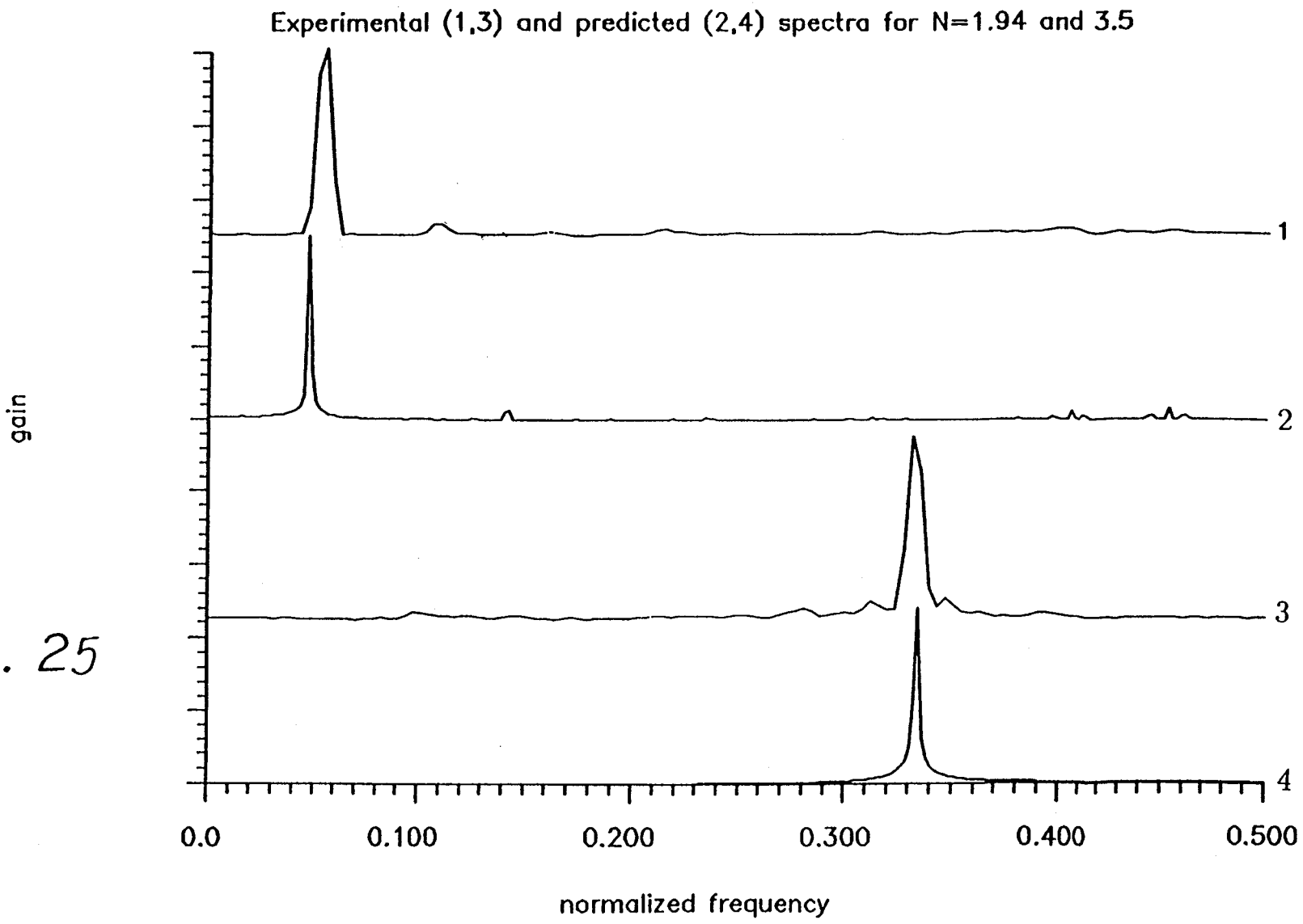
FIG. 25: Spectra of experimental (traces 1,3) and predicted (traces 2,4 ) time-series droplet stream with N=1.94 (traces 1,2) and 3.5 (traces 3,4).

In FIG. 24 are reproductions of the $R_{xx}(m)$s obtained from the experimental droplet traces for N=1.94 and 3.5 (traces 1 and 3 respectively) which were presented in FIG. 15. Superimposed are the $\hat{R}_{xx}(m)$s of the predicted droplet traces for a comparison (traces 2 and 4). Like the autocorrelation functions of the experimental droplet stream which were presented earlier, $\hat{R}_{xx}(m)$ of the predicted droplet stream illustrate a long term periodicity and agreement between experiment and prediction. FIG. 25 likewise illustrates the comparison between the $\hat{S}_x(f)$ for the predicted and experimental droplet patterns. A small shift in normalized frequency between the experimental and predicted droplet stream is apparent when N=1.94. This is also apparent from the $\hat{R}_{xx}(m)$ shown in FIG. 24, indicating that the predicted droplet stream has a small difference from the experimental droplet stream. Despite this small difference, in both the time-domain and frequency-domain representations, the predicted droplet stream characterizes the features of the experimental droplet stream.

Figure 26:
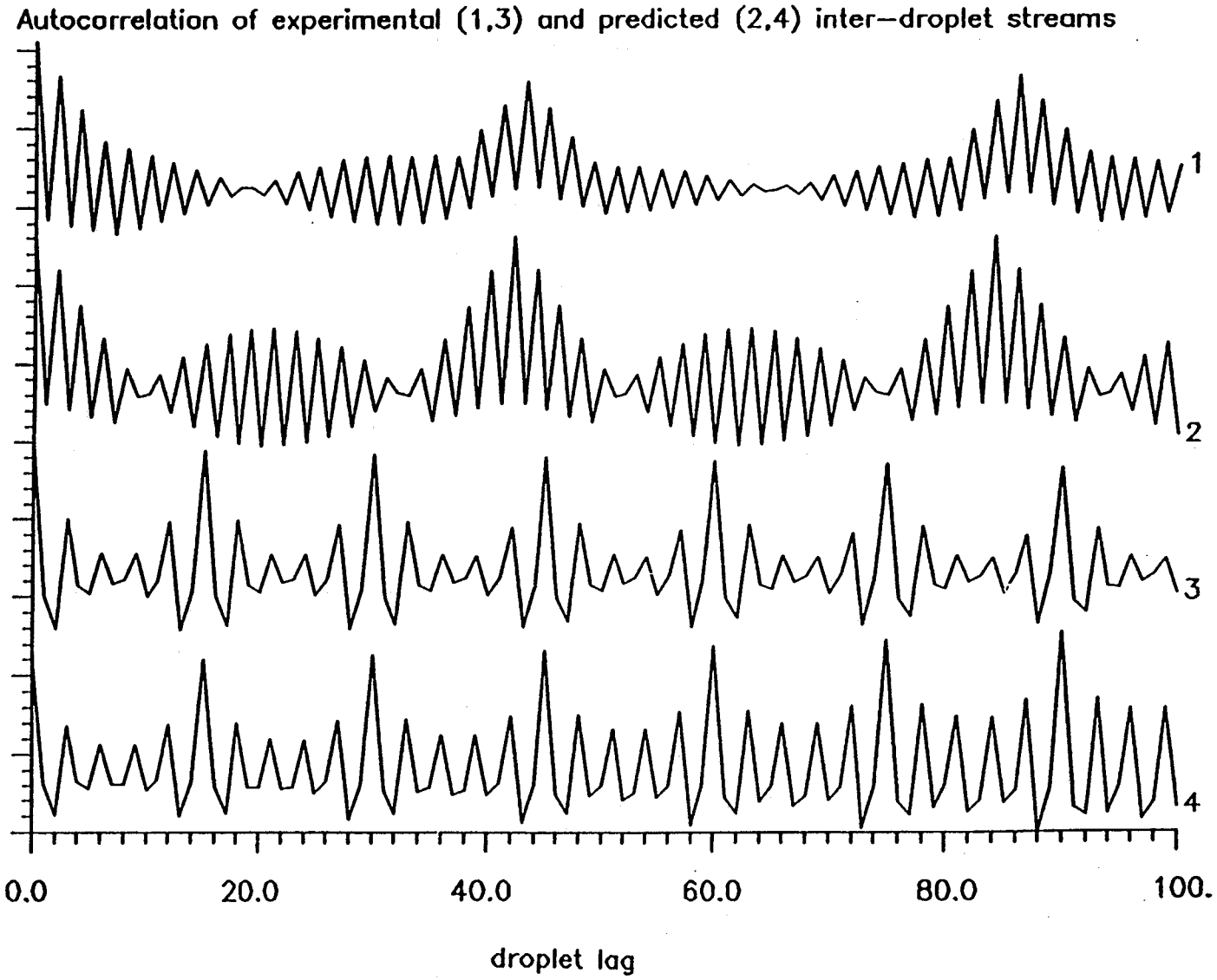
FIG. 26: Autocorrelation function of experimental (traces 1,3) and predicted (traces 2,4) time-series droplet stream with N=5.96 (traces 1,2) and 6.8 (traces 3,4).
Figure 27:
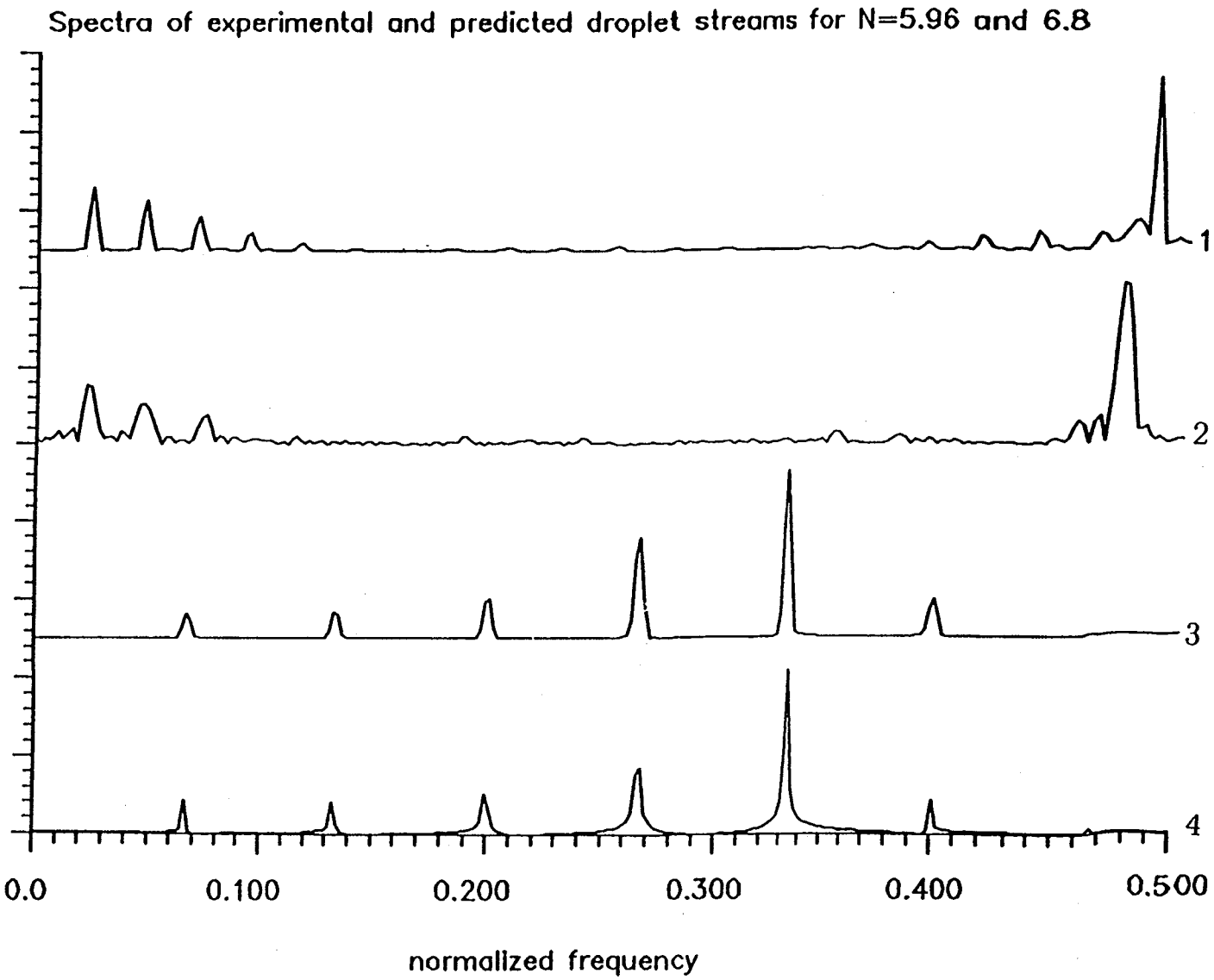
FIG. 27: Spectra of experimental (traces 1,3) and predicted (traces 2,4) time-series droplet stream with N=5.96 (traces 1,2) and 6.8 (traces 3,4).

This is also demonstrated in FIG. 23 for N=5.96 and 6.8. FIG. 26 shows that the droplet pattern (both experimental and predicted) repeat every 44 droplets for N=5.96, and every 15 droplets for N=6.8, which is in agreement with previous observations. The spectra of the droplet patterns for N=5.96 are given in traces 1 and 2 of FIG. 27 for experimental and predicted traces respectively. Excellent agreement is reached as both the spectra from experiment and prediction contain a fundamental normalized frequency of 0.0227 (every 44 drops) and subsequent Fourier harmonics. The highest gain appears at a normalized frequency near 0.485 which corresponds to every 2.06 droplets. Power at 0.485 corresponds to the nearly alternating structure of $\hat{R}_{xx}(m)$ in FIG. 26.

The spectra shown in traces 3 and 4 for the experimental and predicted droplet streams respectively, display a fundamental normalized frequency of 0.066 or every 15 droplets. This is the number of droplets in the repeating pattern which was also observed earlier in the time-domain representation. Most of the power is concentrated at the 4th harmonic, where the normalized frequency is 0.334. This frequency corresponds to a repeating pattern every 3rd drop which is apparent in the structure of $\hat{R}_{xx}(m)$ in FIG. 9. In traces 3 and 4 of that figure, positive correlation is demonstrated every third droplet. This can also be seen in the raw data itself, where the droplets are sequenced according to small-large-small, small-large-small . . . , however use of the autocorrelation function is necessary in order to depict long term correlation. FIGS. 22 through 27 illustrate not only the high degree of agreement between experiment and prediction, but also serve to illuminate the prominent repeatability of the droplet stream patterns. It is also apparent that both the time-domain and the frequency-domain representations provide a different illumination of the characteristics of the droplet stream, even though they contain the same information.

We claim:

1. In an apparatus for manufacturing a net form product, the combination of:

a source of liquid material under pressure;

a chamber;

a support for positioning a product collector in said chamber, said collector defining the shape of a desired product;

liquid droplet stream generator means positioned within said chamber for generating an aligned stream of droplets, said generator means including a nozzle;

conduit means for conducting molten material from said material source to said generator nozzle;

disturbance means for providing an amplitude and time dependent modulated disturbance to said stream at said nozzle to produce a stream of liquid droplets monodispersed in a single line; and drive means for relative movement of said nozzle and said support for impacting liquid droplets of said stream onto said product collector in a predetermined pattern.

2. An apparatus as defined in claim 1 wherein said disturbance means includes means for providing time dependent modulation in the form of a frequency modulation.

3. An apparatus as defined in claim 1 wherein said disturbance means includes means for providing time dependent modulation is in the form of a phase modulation.

4. An apparatus as defined in claim 1 wherein said disturbance means includes means for providing time dependent modulation in the form of an amplitude modulated carrier with a non-integer ratio of carrier frequency to modulation frequency.

5. An apparatus as defined in claim 1 wherein said disturbance means includes means for providing time dependent modulation in segments, with different waveform characteristics in the segments.

6. An apparatus as defined in claim 1 including a plurality of said nozzles and a separate conduit means for each of said nozzles.

7. An apparatus as defined in claim 1 wherein said nozzle is a single stream nozzle.

8. An apparatus as defined in claim 1 wherein said nozzle is a multiple stream nozzle.

9. An apparatus as defined in claim 1 including a plurality of said nozzles and a separate conduit means for each of said nozzles, and wherein each of said nozzles is a multiple stream nozzle.

10. An apparatus as defined in claim 1 including means for controlling the environment in said chamber.

11. An apparatus as defined in claim 10 including means for producing a vacuum in said chamber.

12. An apparatus as defined in claim 10 including means for providing a reactive gas flow in said chamber.

13. An apparatus as defined in claim 1 including a plurality of sources of liquid material under pressure, a plurality of nozzles, and a separate conduit means for connecting each of said nozzles to a separate one of said sources.

14. The apparatus as defined in claim 1 wherein said drive means includes means for rotating said product collector about an axis, and means for moving said nozzle along said axis of rotation.

15. The apparatus as defined in claim 1 wherein said generator means includes first and second generators, each having a nozzle, and said conduit means includes first and second conduits for said first and second generators, respectively, with said nozzles positioned to provide colliding droplet streams for forming disks of said material.

16. The apparatus as defined in claim 15 wherein said generators means includes means for varying the velocities of said streams.

17. The apparatus as defined in claim 1 including means for directing a flow of gas into said droplet stream.

18. The apparatus as defined in claim 17 wherein said means for directly includes means for directing said gas flow countercurrent to said droplet stream.

19. The apparatus as defined in claim 17 wherein said means for directly includes means for directing said gas flow along with said droplet stream.

20. In an apparatus for producing a stream of disk shaped droplets, the combination of;

a source of liquid material under pressure;

a chamber;

droplet stream generator means positioned within said chamber, said generator means including first and second nozzles;

conduit means for conducting liquid material from said material source to each of said generator nozzles for producing intersecting streams;

modulator means for providing an amplitude and time dependent modulated disturbance to said streams to produce droplet streams; and means for maintaining a vacuum in said chamber.

21. The apparatus as defined in claim 20 wherein said generators means includes means for varying the velocities of said streams.

* * * * *